US010386749B2

(12) United States Patent
Kimura

(10) Patent No.: US 10,386,749 B2
(45) Date of Patent: Aug. 20, 2019

(54) DEVELOPING DEVICE INCLUDING A DEVELOPING TANK AND IMAGE FORMING APPARATUS FOR THE DEVELOPING DEVICE

(71) Applicant: SHARP KABUSHIKI KAISHA, Sakai, Osaka (JP)

(72) Inventor: Satoshi Kimura, Sakai (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 0 days.

(21) Appl. No.: 15/986,270

(22) Filed: May 22, 2018

(65) Prior Publication Data

US 2018/0341195 A1 Nov. 29, 2018

(30) Foreign Application Priority Data

May 23, 2017 (JP) ..... 2017-101894

(51) Int. Cl.
*G03G 15/08* (2006.01)
*G03G 15/01* (2006.01)

(52) U.S. Cl.
CPC ..... *G03G 15/0875* (2013.01); *G03G 15/0121* (2013.01); *G03G 15/0889* (2013.01); *G03G 15/0891* (2013.01); *G03G 2215/068* (2013.01)

(58) Field of Classification Search
CPC .. G03G 15/087; G03G 21/10; G03G 15/0844; G03G 15/0894
See application file for complete search history.

(56) References Cited

U.S. PATENT DOCUMENTS 5,526,099 A * 6/1996 Katakabe ..... G03G 15/0822 399/258
7,362,989 B2 * 4/2008 Nishihama ..... G03G 15/0893 399/120
8,805,248 B2 * 8/2014 Sato ..... G03G 15/0844 399/258
9,366,993 B2 * 6/2016 Sato ..... G03G 15/0889

FOREIGN PATENT DOCUMENTS

JP 2011-154180 A 8/2011

* cited by examiner

*Primary Examiner* — Walter L Lindsay, Jr.
*Assistant Examiner* — Arlene Heredia
(74) *Attorney, Agent, or Firm* — ScienBiziP, P.C.

(57) ABSTRACT

A developing device includes: a developing tank that is long in shape and that stores a developer; and a developer carrier that carries the developer stored in the developing tank. The developing tank includes a filling portion through which the developing tank is filled with the developer, the developer carrier is provided on one side in a width direction that is orthogonal to both a longitudinal direction of the developing tank and a vertical direction of the developing tank, and the filling portion is provided on the other side of the developing tank in the width direction, the other side is apart from the developer carrier.

11 Claims, 11 Drawing Sheets

DEVELOPING DEVICE INCLUDING A DEVELOPING TANK AND IMAGE FORMING APPARATUS FOR THE DEVELOPING DEVICE

BACKGROUND

1. Field

The present disclosure relates to a developing device that is included in an image forming apparatus of an electrophotographic system, such as a printer, a copier, or a multifunction peripheral, and the image forming apparatus including the same.

2. Description of the Related Art

FIG. 11 is a schematic perspective view illustrating an example of a developing device 5*x* of the related art. FIG. 12 is a schematic perspective view illustrating a state where an upper cover member 52*x* is detached from the developing device 5*x* illustrated in FIG. 11.

The developing device 5*x* generally includes a developing tank 51*x* that is long in shape and stores a developer, and a developer carrier (specifically, a developing roller 53*x*) that carries the developer stored in the developing tank 51*x*.

The developing tank 51*x* in the developing device 5*x* is usually provided with an upper opening 51*h* (refer to FIG. 12) at which an upper surface is opened and the upper cover member 52*x* (refer to FIG. 11) that closes the upper opening 51*h*.

In the developing device 5*x*, before filling the developing tank with the developer, an operator such as a service person detaches the upper cover member 52*x* from the developing tank 51*x* (refer to FIG. 12) and fills the developing tank 51*x* with the developer from an entire region of the upper opening 51*h* thereof.

Therefore, when filling the developing tank 51*x* with the developer, the operator is desired to perform an operation of detaching the upper cover member 52*x* from the developing tank 51*x*, and accordingly there is inconvenience that an operation of filling the developing tank 51*x* with the developer takes effort.

In this respect, Japanese Unexamined Patent Application Publication No. 2011-154180 discloses a developing device in which a developer guiding member including a filling portion that performs filling with a developer is provided in a surface on one side in a longitudinal direction of a developing tank.

In the developing device, when filling the developing tank with the developer, an operator is able to fill the developing tank with the developer from the filling portion, thus making it possible to facilitate an operation of filling the developing tank with the developer.

In these years, there are increasing cases where a developing device is shipped from a factory in a state where a developing tank is filled with a developer.

However, in the developing device described in Japanese Unexamined Patent Application Publication No. 2011-154180, the filling portion is provided in the surface on the one side in the longitudinal direction of the developing tank, and therefore, when an operator fills the developing tank with the developer, the developer poured from the filling portion easily reaches a developer carrier exposed from the developing tank, and thus there are some cases where the developer leaks out from the developing tank due to shaking, for example, during transportation of the developing device.

The disclosure provides a developing device that is able to facilitate an operation of filling a developing tank with a developer and further able to suppress leakage of the developer from the developing tank due to shaking, for example, during transportation of the developing device, even when the developing device is shipped from a factory in a state where the developing tank is filled with the developer, and an image forming apparatus including the developing device.

SUMMARY

A developing device according to an aspect of the disclosure is a developing device including: a developing tank that is long in shape and stores a developer; and a developer carrier that carries the developer stored in the developing tank, in which the developing tank includes a filling portion through which the developing tank is filled with the developer, the developer carrier is provided on one side in a width direction that is orthogonal to both a longitudinal direction of the developing tank and a vertical direction of the developing tank, and the filling portion is provided on the other side of the developing tank in the width direction, the other side being apart from the developer carrier. Moreover, an image forming apparatus according to an aspect of the disclosure includes the developing device according to the aspect of the disclosure.

DESCRIPTION OF THE EMBODIMENTS

Hereinafter, embodiments according to the disclosure will be described with reference to drawings.

[Image Forming Apparatus]

Figure 1:
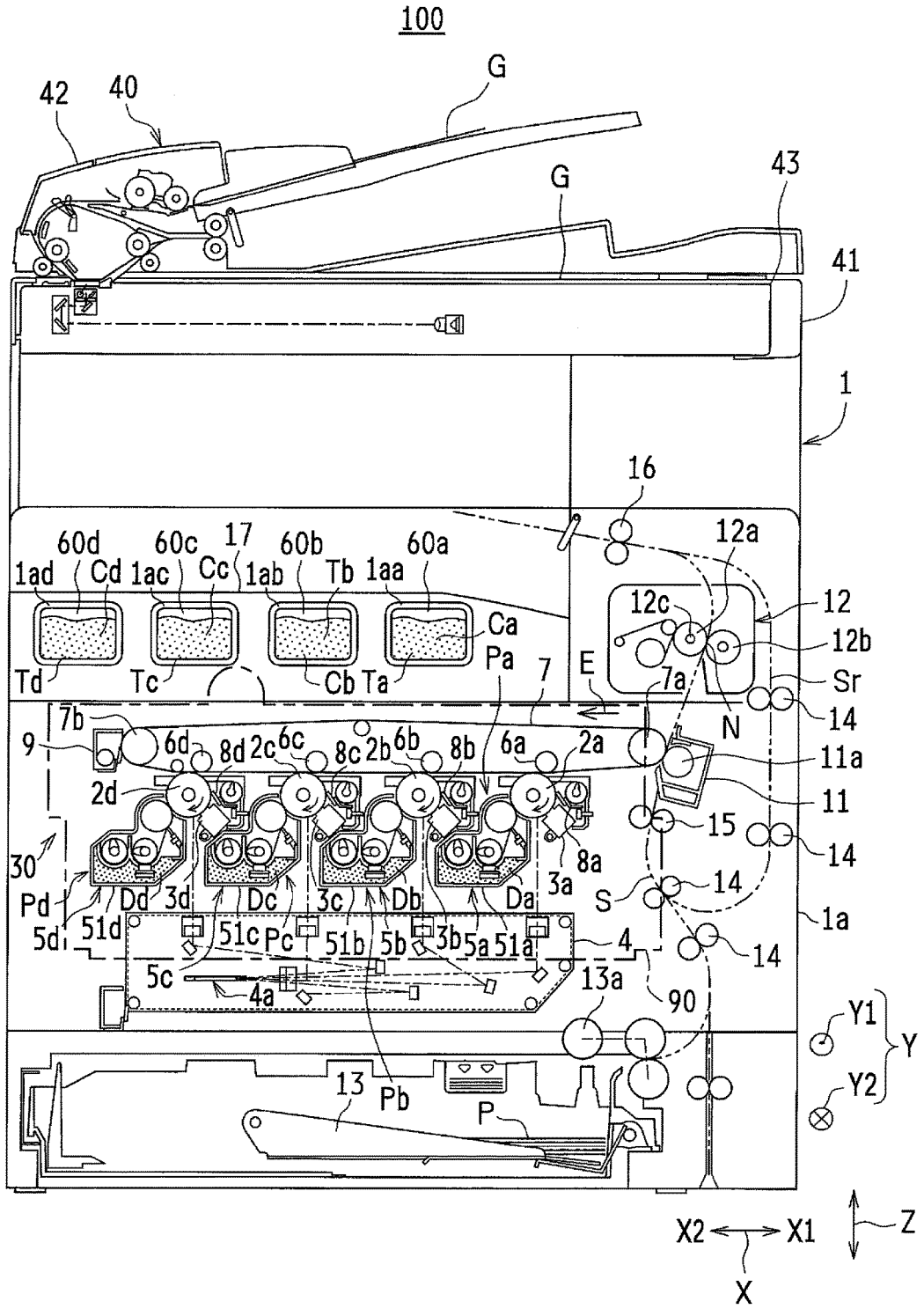
FIG. 1 is a schematic sectional view illustrating an inner structure of an image forming apparatus that includes a developing device according to an embodiment of the disclosure.

FIG. 1 is a schematic sectional view illustrating an inner structure of an image forming apparatus 100 that includes developing devices 5*a*, 5*b*, 5*c*, and 5*d* according to an embodiment of the disclosure.

The image forming apparatus 100 according to the present embodiment is a color image forming apparatus having a configuration in which two or more electrostatic latent image carriers (specifically, photoreceptors) on each of which a toner image is formed are arranged side by side in a predetermined direction (in this example, a right-and-left direction X), which is known as a tandem type. In the example, the image forming apparatus 100 is a color-multifunction peripheral of an intermediate transfer system which is able to form a full-color image. Note that, the image forming apparatus 100 is the color image forming apparatus of the tandem type in the present embodiment, but may be a color image forming apparatus of another type. In addition, the image forming apparatus 100 is the color image forming apparatus, but may be a monochromatic image forming apparatus.

The image forming apparatus 100 forms an image by an image forming unit 30 provided in an apparatus body 1 with toners Ta, Tb, Tc, and Td (hereinafter, denoted by Ta to Td), and collects a waste toner, which is discharged from the image forming unit 30, by a toner collecting container 90 which is detachably attachable to the apparatus body 1. Note that, the toner collecting container 90 is illustrated with a dash dot line in FIG. 1.

Specifically, the image forming apparatus 100 forms an image by the image forming unit 30 with the toners Ta to Td supplied from toner storing portions 60*a*, 60*b*, 60*c*, and 60*d* (hereinafter, denoted by 60*a* to 60*d*) (specifically, toner cartridges) that are detachably attachable to the apparatus body 1.

The image forming apparatus 100 is the image forming apparatus of the electrophotographic system and includes two or more (in the example, four) image forming stations Pa, Pb, Pc, and Pd (hereinafter, denoted by Pa to Pd), an exposure device 4 (specifically, an exposure unit), two or more (in the example, four) primary transfer devices 6*a*, 6*b*, 6*c*, and 6*d* (hereinafter, denoted by 6*a* to 6*d*) (specifically, primary transfer units), an intermediate transfer belt 7 that acts as a toner image carrier carrying a toner image, a belt cleaning device 9 (specifically, a belt cleaning unit), a secondary transfer device 11 (specifically, a secondary transfer unit), a fixing device 12 (specifically, a fixing unit), a recording material storing portion (specifically, a paper feeding device 13) that stores a recording material P such as recording paper, and a frame 1*a*. The frame 1*a* supports constituents of the apparatus body 1, such as the image forming stations Pa to Pd, the exposure device 4, the primary transfer devices 6*a* to 6*d*, the secondary transfer device 11, and the fixing device 12, and forms a housing and a supporting frame of the apparatus body 1. The image forming unit 30 is constituted by the image forming stations Pa to Pd, the exposure device 4, and the primary transfer devices 6*a* to 6*d* in the example. Note that, the image forming unit 30 may be constituted by further including the secondary transfer device 11 and/or the fixing device 12.

The image forming apparatus 100 is provided with an image reading device 40 that is arranged above the apparatus body 1. The image reading device 40 includes an image reading unit 41 which reads an image of a document G, a document conveyance unit 42 which conveys the document G, and a document loading table 43 on which the document G is loaded.

The image reading device 40 reads, by the image reading unit 41, the document G that is conveyed by the document conveyance unit 42, or reads, by the image reading unit 41, the document G that is loaded on the document loading table 43. The image of the document G, which has been read by the image reading device 40 is sent, as image data, to the apparatus body 1, or image data from external equipment is sent to the apparatus body 1, and an image that is formed on the basis of the image data in the image forming apparatus 1 is recorded on a recording material P.

The image forming stations Pa to Pa respectively include two or more (in the example, four) photoreceptors 2*a*, 2*b*, 2*c*, and 2*d* (hereinafter, denoted by 2*a* to 2*d*) (specifically, photoreceptor drums) each of which acts as an electrostatic latent image carrier, charging devices 3*a*, 3*b*, 3*c*, and 3*d* (hereinafter, denoted by 3*a* to 3*d*) (specifically, charging units), developing devices 5*a*, 5*b*, 5*c*, and 5*d* (hereinafter, denoted by 5*a* to 5*d*) (specifically, developing units), and photoreceptor cleaning devices 8*a*, 8*b*, 8*c*, and 8*d* (hereinafter, denoted by 8*a* to 8*d*) (specifically, photoreceptor cleaning units). Around the photoreceptors 2*a* to 2*d*, the charging devices 3*a* to 3*d*, the developing devices 5*a* to 5*d*, and the photoreceptor cleaning devices 8*a* to 8*d* are respectively disposed in this order.

In the image forming stations Pa to Pd, the toner storing portions 60*a* to 60*d* in each of which the corresponding one of the toners Ta to Td of respective colors of black (B), cyan (C), magenta (M), and yellow (Y) is stored are respectively connected to the developing devices 5*a* to 5*d* so as to be detachably attachable, and, while respectively supplying the toners Ta to Td to the developing devices 5*a* to 5*d* from the toner storing portions 60*a* to 60*d*, toner images of the respective colors of black (B), cyan (C), magenta (M), and yellow (Y) are formed on the photoreceptors 2*a* to 2*d* by developers Da, Db, Dc, and Dd (hereinafter, denoted by Da to Dd) of the respective colors in the developing devices 5*a* to 5*d*. In the example, the developers Da to Dd are two-component developers in which the toners Ta to Td and carriers Ca, Cb, Cc, and Cd (hereinafter, denoted by Ca to Cd) are components, respectively. Note that, the developers Da to Dd may be one-component developers in which the toners Ta to Td are components, respectively.

The toner collecting container 90 and the toner storing portions 60*a* to 60*d* are detachably attachable to the apparatus body 1. Thereby, a user is able to replace the toner collecting container 90 or any of the toner storing portions 60*a* to 60*d* as appropriate.

Specifically, the apparatus body 1 is provided with insertion holes 1*aa*, 1*ab*, 1*ac*, and 1*ad* (hereinafter, denoted by 1*aa* to 1*ad*) which extend along a depth direction Y and through which the toner storing portions 60*a* to 60*d* are respectively inserted in the depth direction Y. In this case, the depth direction Y means a direction from, an operation side of the image forming unit 30 (in the example, a front side of the apparatus body 1) to a side opposite to the operation side (in the example, a rear side of the apparatus body 1) and a direction from the side opposite to the operation side of the image forming unit 30 to the operation side. In the example, a direction from a rear side of the image forming apparatus 100 toward a front side thereof is set as one side Y1 in the depth direction Y, and a direction from the front side of the image forming apparatus 100 toward the rear side thereof is set as the other side Y2 in the depth direction Y. Moreover, a right side of the right-and-left direction X, which is viewed from the front side, is set as one side X1, and a left side of the right-and-left direction X, which is viewed from, the front side, is set as the other side X2.

When being inserted into the insertion holes 1*aa* to 1*ad* in the apparatus body 1 toward the rear side of the depth direction Y, the toner storing portions 60*a* to 60*d* are to be attached to the apparatus body 1. Moreover, when being drawn, out toward the front side (in the example, the operation side) of the depth direction Y, the toner storing portions 60*a* to 60*d* are to be separated from the apparatus body 1.

The toner storing portions 60*a* to 60*d* are arranged side by side in the right-and-left direction X that is orthogonal to the depth direction Y. The image forming unit 30 is provided below the toner storing portions 60*a* to 60*d*.

The charging devices 3*a* to 3*d* uniformly charge surfaces of the photoreceptors 2*a* to 2*d*, respectively. The exposure device 4 exposes the surfaces of the photoreceptors 2*a* to 2*d* that have been uniformly charged by the charging devices 3*a* to 3*d*, and forms an electrostatic latent image on each of the surfaces of the photoreceptors 2*a* to 2*d*. The developing devices 5*a* to 5*d* have developing tanks 51*a* to 51*d* in which developers Da to Dd are stored, respectively, and develop the respective electrostatic latent images, which have been formed on the surfaces of the photoreceptors 2*a* to 2*d* by the exposure device 4, by using the developers Da to Dd and thereby form visible images.

The primary transfer devices 6*a* to 6*d* primarily transfer, onto the intermediate transfer belt 7, toner images formed on the photoreceptors 2*a* to 2*d*.

Each of the photoreceptor cleaning devices 8*a* to 8*d* includes a cleaning member (specifically, a cleaning blade), and collects, as a waste toner, by the cleaning member, a residual toner that has not been transferred onto the intermediate transfer belt 7 by the corresponding one of the primary transfer devices 6*a* to 6*d* and remains on a surface of the corresponding one of the photoreceptors 2*a* to 2*d*, and conveys the waste toner toward the toner collecting container 90.

The secondary transfer device 11 secondarily transfers, onto the recording material P, the toner images that have been primarily transferred onto the intermediate transfer belt 7. In the example, the secondary transfer device 11 includes a secondary transfer roller 11*a*. The secondary transfer roller 11*a* electrostatically transfers, onto the recording material P, the toner images that have been transferred onto the intermediate transfer belt 7 by the primary transfer devices 6*a* to 6*d*, and forms an unfixed toner image on the recording material P.

The belt cleaning device 9 collects, as a waste toner, a residual toner that has not been transferred onto the recording material P by the secondary transfer device 11 and remains on the intermediate transfer belt 7, and conveys the waste toner to the toner collecting container 90.

The toner collecting container 90 is provided on the front side (in the example, the operation side) of the depth direction Y. The toner collecting container 90 collects waste toners that have been sent from the photoreceptor cleaning devices 8*a* to 8*d* or the belt cleaning device 9.

The intermediate transfer belt 7 is provided so as to face the photoreceptors 2*a* to 2*d*. The intermediate transfer belt 7 is stretched between a driving roller 7*a* and a driven roller 7*b*, and rotates (circularly moves) in a predetermined rotation direction E which has been determined in advance, when the driving roller 7*a* is rotationally driven. The secondary transfer device 11 is disposed on the driving roller 7*a* side of the intermediate transfer belt 7 and the belt cleaning device 9 is disposed on the driven roller 7*b* side of the intermediate transfer belt 7.

The exposure device 4 is configured to respectively scan the surfaces of the four photoreceptors 2*a* to 2*d*, each of which is rotationally driven in a predetermined direction, in a main scanning direction (rotation axis direction of the corresponding one of the photoreceptors) with four light beams (specifically, laser beams) from a light source portion 4*a* that includes a polygon mirror. The exposure device 4 forms an electrostatic latent image on each of the surfaces of the photoreceptors 2*a* to 2*d* on the basis of image data according to a color image using respective colors of a black (B) component, a cyan (C) component, a magenta (M) component, and a yellow (Y) component or image data according to a monochromatic image using a single color (for example, black), each of which is input from an outside.

The fixing device 12 fixes the unfixed toner image, which has been transferred onto the recording material P by the secondary transfer device 11, onto the recording material P by heat and pressure. Specifically, the fixing device 12 includes a heat source 12*c* such as a heater, a fixing roller 12*a* that is subjected to temperature control so that temperature thereof is maintained to be predetermined temperature, which has been determined in advance, by operation control of the heat source 12*c*, and a pressure roller 12*b* that is in pressure contact with the fixing roller 12*a*. The fixing device 12 is configured to heat the fixing roller 12*a* by the heat source 12*c* so as to have predetermined fixing temperature, and to thereafter cause the recording material P, on which an unfixed image (specifically, the unfixed toner image) is formed, to pass through a fixing nip portion N to thereby fix the unfixed image (specifically, the unfixed toner image) onto the recording material P by heat and pressure in the fixing nip portion N.

In the image forming apparatus 100 described above, when an image is formed, the surfaces of the photoreceptors 2*a* to 2*d* are uniformly charged by the charging devices 3*a* to 3*d*, respectively, each of the surfaces of the photoreceptors 2*a* to 2*d*, which have been uniformly charged, is subjected to laser exposure by the exposure device 4 in accordance with image data (image information), and an electrostatic latent image is formed on each of the photoreceptors 2*a* to 2*d*.

Thereafter, in the image forming apparatus 100, the electrostatic latent image formed on the corresponding one of the photoreceptors 2*a* to 2*d* is developed by the corresponding one of the developing devices 5*a* to 5*d* so as to be visualized as a toner image, the visualized toner image is transferred onto the intermediate transfer belt 7 by the corresponding one of the primary transfer devices 6*a* to 6*d* to each of which a bias voltage whose polarity is opposite to that of the toners Ta to Td is applied, and a toner image is formed on the intermediate transfer belt 7.

Next, in the image forming apparatus 100, the toner image formed on the intermediate transfer belt 7 is conveyed to the secondary transfer device 11 by the intermediate transfer belt 7 that is rotated in the predetermined rotation direction E. On the other hand, the recording material P that has been drawn out from a paper feeding roller 13*a* of the paper feeding device 13 toward a conveyance path S and conveyed through the conveyance path S is conveyed to the secondary transfer device 11 by a conveyance roller 14 and a resist roller 15 in synchronization with the toner image on the intermediate transfer belt 7. Then, the toner image conveyed to the secondary transfer device 11 is transferred by the secondary transfer device 11 onto the recording material P conveyed to the secondary transfer device 11.

Thereafter, in the image forming apparatus 100, the toner image transferred onto the recording material P is conveyed to the fixing device 12, the toner image on the recording material P is heated and pressured to be fused and fixed onto the recording material P at a time of passing through the fixing device 12, the recording material P subjected to fixing processing of the toner image by the fixing device 12 is discharged to an outside of the apparatus body 1 by a discharging roller 16 to be loaded on a discharging tray 17, and image formation processing ends.

Moreover, the conveyance path S includes a reversing path Sr through which the recording material P conveyed in an opposite direction by the discharging roller 16 is guided to an upstream side of the resist roller 15 so that front and back sides are reversed. In a case of performing image formation not only on a front surface of the recording material P but also on a back surface thereof, the image forming apparatus 100 conveys the recording material P from the discharging roller 16 to the reversing path Sr in the opposite direction, reverses the front and back sides of the recording material P, guides the recording material P to the resist roller 15 again, forms and fixes a toner image on the back surface of the recording material P similarly to the front surface of the recording material P, and thereafter discharges the recording material P to the outside of the apparatus body 1 to load the recording material P on the discharging tray 17.

(Developing Device)

Figure 2:
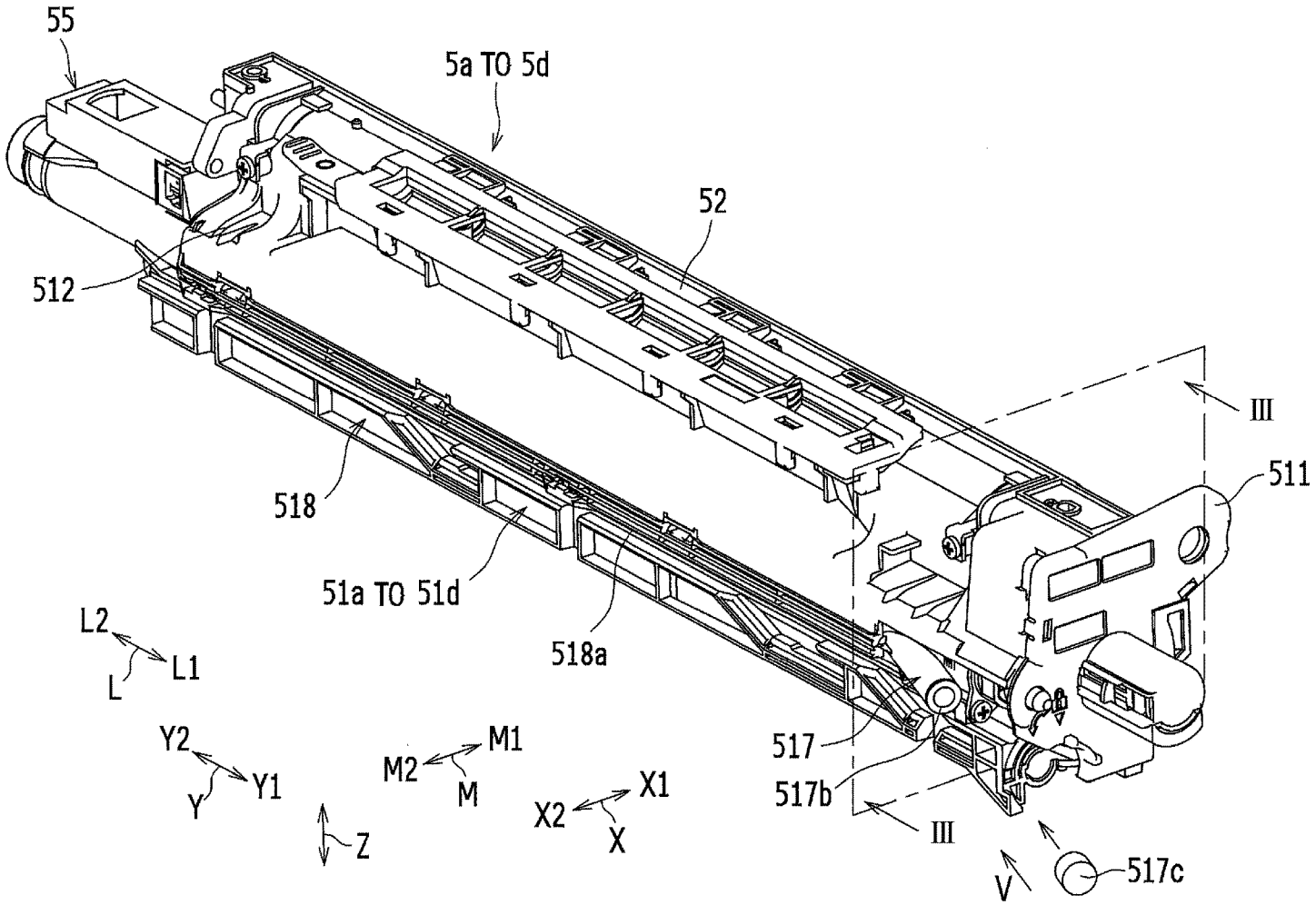
FIG. 2 is a schematic perspective view in an obliquely downward direction of a front side of the developing device illustrated in FIG. 1.
Figure 3:
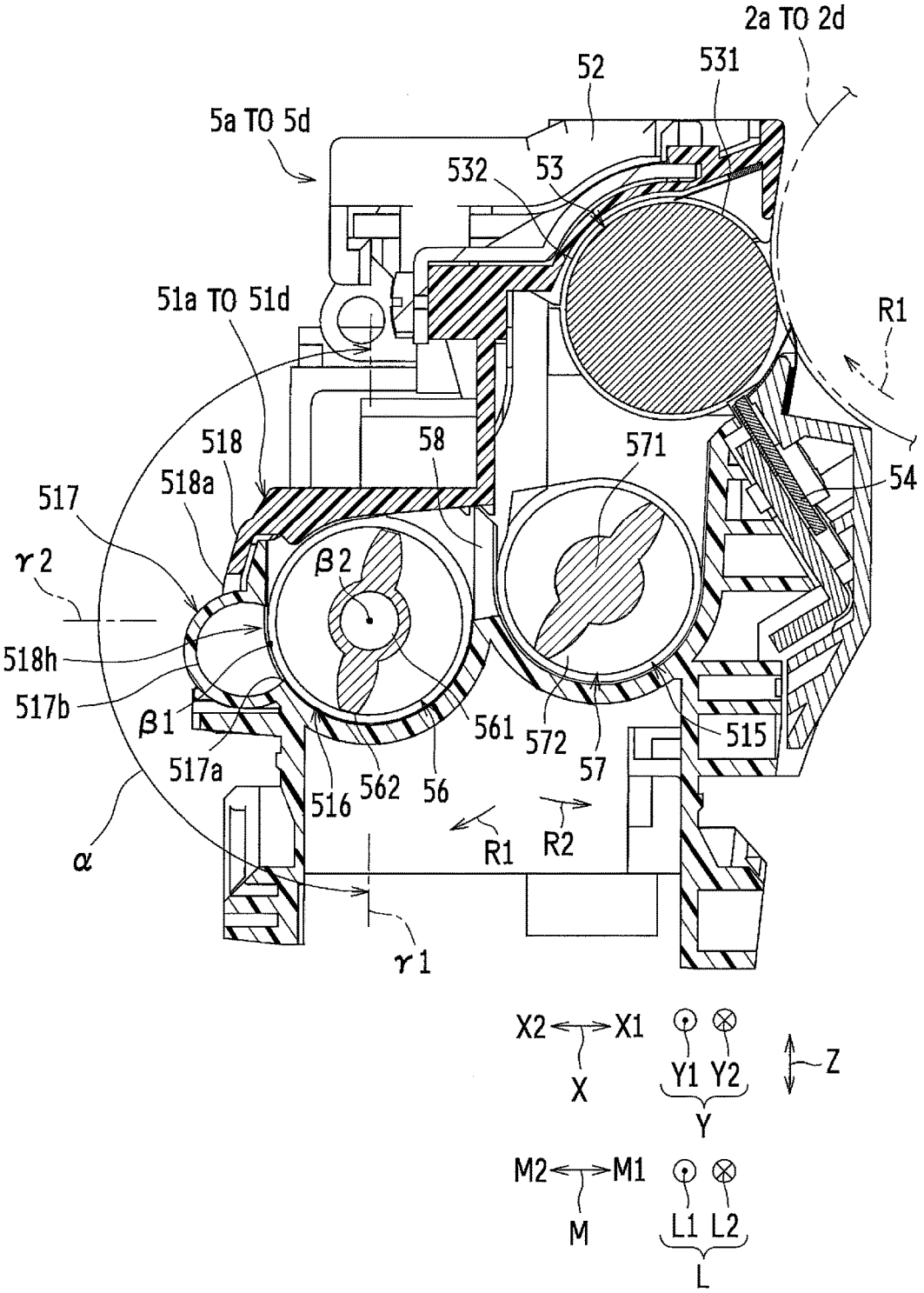
FIG. 3 is a schematic cross sectional view taken along a III-III surface illustrated in FIG. 2 of the developing device illustrated in FIG. 1.
Figure 4:
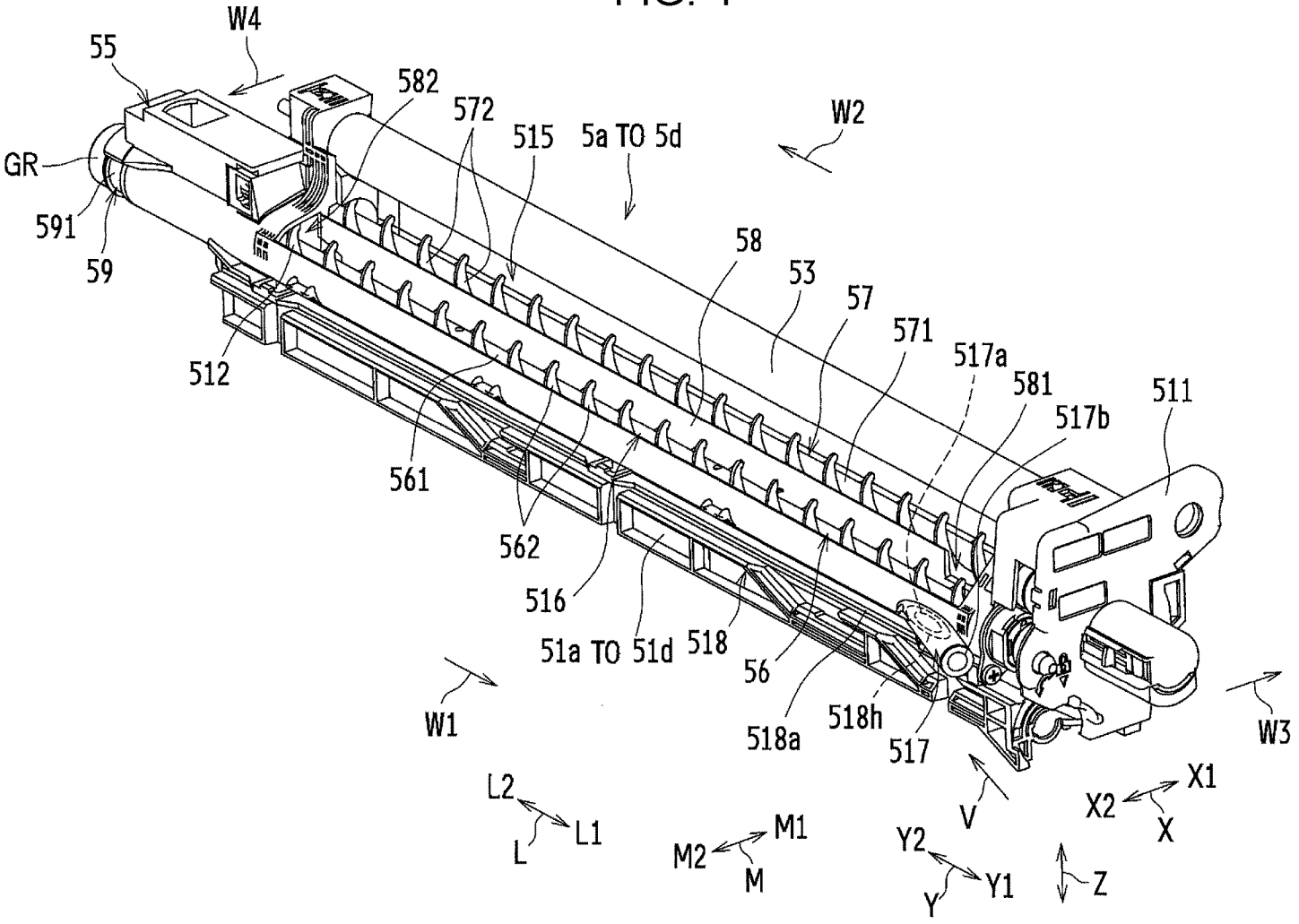
FIG. 4 is a schematic perspective view in an obliquely downward direction of the front side of the developing device which is illustrated in FIG. 1 and is in a state where an upper cover member is detached.

FIG. 2 is a schematic perspective view in an obliquely downward direction of a front side of each of the developing devices 5*a* to 5*d* illustrated in FIG. 1. FIG. 3 is a schematic cross sectional view of each of the developing devices 5*a* to 5*d* illustrated in FIG. 1, which is taken along a III-III surface illustrated in FIG. 2. FIG. 4 is a schematic perspective view in an obliquely downward direction of the front side of each of the developing devices 5*a* to 5*d* which are illustrated in FIG. 1 and each of which is in a state where an upper cover member 52 is detached. FIG. 2 to FIG. 4 illustrate a state where the developers Da to Dd are not stored in the developing tanks 51*a* to 51*d*.

Note that, the developing devices 5*a* to 5*d* illustrated in FIG. 1 have substantially similar configurations, so that FIG. 2 to FIG. 4 illustrate one of the developing devices 5*a* to 5*d*. This will be applied to FIG. 5 to FIG. 10 described below.

The developing devices 5*a* to 5*d* include the developing tanks 51*a* to 51*d* that are long in shape and that respectively store the developers Da to Dd (refer to FIG. 1), and developing rollers 53 (refer to FIG. 3 and FIG. 4) that are long and act as developer carriers carrying the developers Da to Dd stored in the developing tanks 51*a* to 51*d*. Note that, each of the developer carriers may have a belt-like shape.

In addition to storing the developers Da to Dd, the developing tanks 51*a* to 51*d* form device bodies each of which supports constituents of the corresponding one of the developing devices 5*a* to 5*d*. A weight ratio of the toners Ta to Td (refer to FIG. 1) to the developers Da to Dd in the developing tanks 51*a* to 51*d* is normally set to be about several percent. The toners Ta to Td and the carriers Ca to Cd (refer to FIG. 1) are respectively mixed, agitated, and charged in the developing tanks 51*a* to 51*d*.

Each of the developing devices 5*a* to 5*d* further includes a doctor blade 54 (refer to FIG. 3) that regulates a layer thickness of the corresponding one of the developers Da to Dd and a toner receiving portion 55 (refer to FIG. 2 and FIG. 4) that receives the corresponding one of the toners Ta to Td from the corresponding one of the toner storing portions 60*a* to 60*d* (refer to FIG. 1).

Each of the developing rollers 53 is provided on one side M1 (in the example, the right side viewed from the front) in a width direction M (in the example, the right-and-left direction X) that is orthogonal to both a longitudinal direction L (in the example, the depth direction Y) of the corresponding one of the developing tanks 51*a* to 51*d* and a vertical direction Z of the corresponding one of the developing tanks 51*a* to 51*d*.

A rotation axis direction of each of the developing rollers 53 extends along the longitudinal direction L of the corresponding one of the developing tanks 51*a* to 51*d*. The developing roller 53 is disposed so as to be proximate to or in contact with the corresponding one of the photoreceptors 2*a* to 2*d* (refer to FIG. 3). The developing roller 53 includes a magnet roller 531 (refer to FIG. 3) that has two or more magnet bodies (not illustrated) and a developing sleeve 532 (refer to FIG. 3) that contains the magnet roller 531 and is in a cylindrical shape.

The magnet roller 531 is supported by both side walls 511 and 512 (refer to FIG. 2 and FIG. 4) on one side L1 and the other side L2 in the longitudinal direction L of the corresponding one of the developing tanks 51*a* to 51*d* so as not to be rotatable. The developing sleeve 532 is externally fitted to the magnet roller 531, and supported by the both side walls 511 and 512 of the corresponding one of the developing tanks 51*a* to 51*d* so as to be appropriately rotatable.

Each of the developing rollers 53 adsorbs the corresponding one of the carriers Ca to Cd of the developers Da to Dd in the developing tanks 51*a* to 51*d* to the developing sleeve 532 in the developing roller 53 by magnetic force of the magnet roller 531, and thereby forms naps (commonly known as a magnetic brush) of the corresponding one of the developers Da to Dd.

The doctor blade 54 is provided for each of the developing tanks 51*a* to 51*d* so that an edge part thereof is apart from the developing sleeve 532 at a predetermined interval. Thereby, the doctor blade 54 is able to regulate the layer thickness of the developer (in other words, heights of naps of the magnetic brush).

Moreover, in the developing roller 53, when rotation driving force from a rotation driving portion (not illustrated) is transmitted to the developing sleeve 532, the developing sleeve 532 rotates in a predetermined second rotation direction R2 (refer to FIG. 3) that is opposite to a predetermined first rotation direction R1 (refer to FIG. 3) of each of the photoreceptors 2*a* to 2*d*. Thereby, the developing rollers 53 are able to supply the developers Da to Dd to the photoreceptors 2*a* to 2*d*.

In the developing devices 5*a* to 5*d* each of which has such a configuration, when electrostatic latent images formed on the photoreceptors 2*a* to 2*d* are developed by an image forming operation of the image forming apparatus 100, the developers Da to Dd on the developing sleeves 532 are conveyed toward the photoreceptors 2*a* to 2*d* in accordance with rotation of the developing sleeves 532 in the second rotation direction R2. The toners Ta to Td respectively adhering to the carriers Ca to Cd are supplied to the photoreceptors 2*a* to 2*d* that rotate in the first rotation direction R1 and adsorbed by the electrostatic latent images on the photoreceptors 2*a* to 2*d*, respectively. Thereby, the electrostatic latent images on the photoreceptors 2*a* to 2*d* are developed. At this time, the toners Ta to Td in the developers Da to Dd are consumed, and toner concentration of the developers Da to Dd in the developing tanks 51*a* to 51*d* is gradually lowered. Therefore, in the developing devices 5*a* to 5*d*, the developing tanks 51*a* to 51*d* are replenished from the toner receiving portions 55 with the toners Ta to Td from the toner storing portions 60*a* to 60*d*.

Moreover, the developing devices 5*a* to 5*d* are configured to circulate and convey the developers Da to Dd in the developing tanks 51*a* to 51*d*, respectively.

Specifically, each of the developing devices 5*a* to 5*d* further includes one or more (in the example, two) agitating-conveying members that, while agitating the corresponding one of the developers Da to Dd in the developing tanks 51*a* to 51*d*, convey the developer in the longitudinal direction L of the corresponding one of the developing tanks 51*a* to 51*d*. In the example, the agitating-conveying members are long and spiral members [specifically, a first spiral member 56 (refer to FIG. 3 and FIG. 4) and a second spiral member 57 (refer to FIG. 3 and FIG. 4)].

Each of the first spiral members 56 and each of the second spiral members 57 are supported by the both side walls 511 and 512 in the longitudinal direction L of the corresponding one of the developing tanks 51*a* to 51*d* via bearings (not illustrated) so as to be appropriately rotatable.

Each of the first spiral members 56 conveys the corresponding one of the developers Da to Dd to the one side L1 [first conveyance direction W1 (refer to FIG. 4)] in the longitudinal direction L. Each of the second spiral members 57 conveys the corresponding one of the developers Da to Dd to the other side L2 [second conveyance direction W2 (refer to FIG. 4)] in the longitudinal direction L. Each of the first spiral members 56 and each of the second spiral members 57 are configured to agitate the corresponding one of the developers Da to Dd in a direction orthogonal to the longitudinal direction L of the corresponding one of the developing tanks 51*a* to 51*d*.

In the example, the first spiral member 56 and the second spiral member 57 respectively have agitating-conveying portions 562 and 572 in a spiral shape (refer to FIG. 3 and FIG. 4) each of which rotates around an axis extending along the longitudinal direction L of the corresponding one of the developing tanks 51*a* to 51*d*.

Specifically, the first spiral member 56 is arranged parallel slightly (by a predetermined distance)below the second spiral member 57 on the other side M2 in the width direction M of the corresponding one of the developing tanks 51*a* to 51*d*. The first spiral member 56 has a rotation axis 561 (refer to FIG. 3 and FIG. 4) and the agitating-conveying portion 562 that is in the spiral shape. The rotation axis 561 is supported by the both side walls 511 and 512 so as to be appropriately rotatable. The agitating-conveying portion 562 is provided on the rotation axis 561. A spiral direction of the agitating-conveying portion 562 extends along the longitudinal direction L of the corresponding one of the developing tanks 51*a* to 51*d*. The agitating-conveying portion 562 is formed to convey the corresponding one of the developers Da to Dd toward the one side L1 (first conveyance direction W1) of the longitudinal direction L by rotation in a predetermined rotation direction (in the example, the first rotation direction R1).

The second spiral member 57 is arranged parallel to the first spiral member 56 on a side closer to the developing roller 53 in the width direction M of the corresponding one of the developing tanks 51*a* to 51*d* than the first spiral member 56 is [in the example, a side below the developing roller 53 and slightly (by a predetermined distance) apart from the corresponding one of the photoreceptors 2*a* to 2*d*]. The second spiral member 57 has a rotation axis 571 (refer to FIG. 3 and FIG. 4) and the agitating-conveying portion 572 that is in the spiral shape. The rotation axis 571 extends along the longitudinal direction L and is supported by the both side walls 511 and 512 so as to be appropriately rotatable. The agitating-conveying portion 572 is provided on the rotation axis 571. A spiral direction of the agitating-conveying portion 572 extends along the longitudinal direction L of the corresponding one of the developing tanks 51*a* to 51*d*. The agitating-conveying portion 572 is formed to convey the corresponding one of the developers Da to Dd toward the other side L2 (second conveyance direction W2) of the longitudinal direction L by rotation in a predetermined rotation direction (in the example, the second rotation direction R2).

At an end part of either the first spiral member 56 or the second spiral member 57 (in the example, the first spiral member 56), which is on the other side L2 in the longitudinal direction L, a drive transmitting member [in the example, a drive gear GR (refer to FIG. 4)] is provided.

Moreover, a drive transmitting unit 59 (refer to FIG. 4) configured to transmit rotation driving force, which is from the drive transmitting member (in the example, the drive gear GR), from either the first spiral member 56 or the second spiral member 57 (in the example, the first-spiral member 56) to the other (in the example, the second spiral member 57) is provided.

In the example, the drive transmitting unit 59 transmits the rotation driving force, which is from the drive gear GR, from the first spiral member 56 to the second spiral member 57 so that the first spiral member 56 and the second spiral member 57 rotate in opposite directions.

Specifically, the drive transmitting unit 59 includes a first gear 591 (refer to FIG. 4) and a second gear 592 (refer to FIG. 5 described below) that is engaged with the first gear 591. The first gear 591 is provided on the end part of the first spiral member 56, which is on the other side L2 in the longitudinal direction L, adjacent to the drive gear GR, and rotates with rotation of the drive gear GR. The second gear 592 is provided on the end part of the second spiral member 57, which is on the other side L2 in the longitudinal direction L, and is engaged with the first gear 591.

Note that, the agitating-conveying member is not limited to a member that is in the spiral shape, and any member may be used as long as being able to agitate and convey the developers Da to Dd. Moreover, the drive transmitting unit 59 may include a pulley and a belt.

In each of the developing tanks 51*a* to 51*d*, two or more (in the example, two) flow paths through which the corresponding one of the developers Da to Dd is caused to pass are formed. The corresponding one of the developers Da to Dd is caused to pass through a first flow path 515 (refer to FIG. 3 and FIG. 4) which is one of the two or more flow paths on the one side M1 (in the example, the right side viewed from the front) in the width direction M, and the corresponding one of the developers Da to Dd is caused to pass through a second flow path 516 (refer to FIG. 3 and FIG. 4) which is another one of the two or more flowpaths on the other side M2 (in the example, the left side viewed from, the front) in the width direction M, which is further apart from the developing roller 53 than the first flow path 515 is.

In the example, the first flow path 515 is a flow-path through which the corresponding one of the developers Da to Dd is supplied to the developing roller 53. The corresponding one of the developers Da to Dd is caused to pass through the first flow path 515 from the one side L1 in the longitudinal direction L toward the other side L2 (first conveyance direction W1). The second flow path 516 is a flow path that is adjacent to the first flow path 515 and communicates with the first flow path 515. The corresponding one of the developers Da to Dd is caused to pass through the second flow path 516 from the other side L2 in the longitudinal direction L toward the one side L1 (second conveyance direction W2). The first spiral member 56 is provided in the second flow path 516, and the second spiral member 57 is provided in the first flow path 515.

In each of the developing tanks 51*a* to 51*d*, a partition wall 58 (refer to FIG. 3 and FIG. 4) that partitions an inside of the corresponding one of the developing tanks 51*a* to 51*d* in the width direction M is provided. Thereby, the first spiral member 56 is able to reliably convey the corresponding one of the developers Da to Dd to the one side L1 (first conveyance direction W1) in the longitudinal direction L while agitating the developer on the other side M2 in the width direction M. Moreover, the second spiral member 57 is able to reliably convey the corresponding one of the developers Da to Dd to the other side L2 (second conveyance direction W2) in the longitudinal direction L while agitating the developer on the one side M1 in the width direction M.

Specifically, in each of the developing tanks 51*a* to 51*d*, the partition wall 58 partitions a part for storing the corresponding one of the developers Da to Dd into the first flow path 515 and the second flow path 516. The partition wall 58 is provided between the first spiral member 56 and the second spiral member 57.

More specifically, the partition wall 58 extends along the longitudinal direction L (specifically, the rotation axis direction of the developing roller 53) in the corresponding one of the developing tanks 51*a* to 51*d*. The partition wall 58 is a member having a plate-like shape along the longitudinal direction L and the vertical direction Z.

The partition wall 58 divides the corresponding one of the developing tanks 51*a* to 51*d* in a part (in the example, a center part) in the longitudinal direction L. Thereby, each of the developers Da to Dd is able to be circulated between the first flow path 515 and the second flow path 516.

Specifically, on both sides (in the example, both end parts) of each of the developing tanks 51*a* to 51*d* in the longitudinal direction L, a first communication path 581 and a second communication path 582 (refer to FIG. 4) are formed. The first flow path 515 and the second flow path 516 communicate with each other via the first communication path 581 and the second communication path 582 on the both sides (in the example, the both end parts) of the corresponding one of the developing tanks 51*a* to 51*d* in the longitudinal direction L. Thereby, the first communication path 581 is able to cause the corresponding one of the developers Da to Dd to flow out to the one side M1 [third conveyance direction W3 (refer to FIG. 4)] in the width direction M on the one side L1 in the longitudinal direction L. Moreover, the second communication path 582 is able to cause the corresponding one of the developers Da to Dd to flow out to the other side M2 [fourth conveyance direction W4 (refer to FIG. 4)] in the width direction M on the other side L2 in the longitudinal direction L. Specifically, the first communication path 581 makes the partition wall 58 open on the one side L1 in the longitudinal direction L. The second communication path 582 makes the partition wall 58 open on the other side L2 in the longitudinal direction L.

In each of the developing devices 5*a* to 5*d* described above, when the rotation driving force in the first rotation direction R1 is transmitted to the drive gear GR from the rotation driving portion (not illustrated), the first spiral member 56 rotates in the first rotation direction R1. Further, the rotation driving force from the drive gear GR is transmitted to the second spiral member 57 via the first gear 591 and the second gear 592, and thus the second spiral member 57 rotates in the second rotation direction R2. Accordingly, each of the developers Da to Dd is conveyed to the one side L1 (first conveyance direction W1) in the longitudinal direction L while being agitated by the rotation of the first spiral member 56 in the first rotation direction R1. Moreover, each of the developers Da to Dd is conveyed to the other side L2 (second conveyance direction W2) in the longitudinal direction L while being agitated by the rotation of the second spiral member 57 in the second rotation direction R2. Then, as illustrated in FIG. 4, each of the developers Da to Dd moves in the second flow path 516 from the other side L2 in the longitudinal direction L to the one side L1 (first conveyance direction W1), passes through the first communication path 581 on the one side L1 to be conveyed to the one side M1 (third conveyance direction W3) in the width direction M, and reaches the first flow path 515. Moreover, each of the developers Da to Dd moves in the first flow path 515 from the one side L1 in the longitudinal direction L to the other side L2 (second conveyance direction W2), passes through the second communication path 582 on the other side L2 to be conveyed to the other side M2 (fourth conveyance direction W4) in the width direction M, and reaches the second flow path 516. In this manner, each of the developers Da to Dd is conveyed so as to be circulated between the first flow path 515 and the second flow path 516 while being agitated in the corresponding one of the developing tanks 51*a* to 51*d*.

(Filling Portion of Developer)

The developing tanks 51*a* to 51*d* include filling portions 517 (refer to FIG. 2 to FIG. 4) through which the developing tanks 51*a* to 51*d* are respectively filled with the developers Da to Dd.

Each of the filling portions 517 is provided on the other side M2, which is apart from the developing roller 53 in the width direction M, of the corresponding one of the developing tanks 51*a* to 51*d*.

Figure 5:
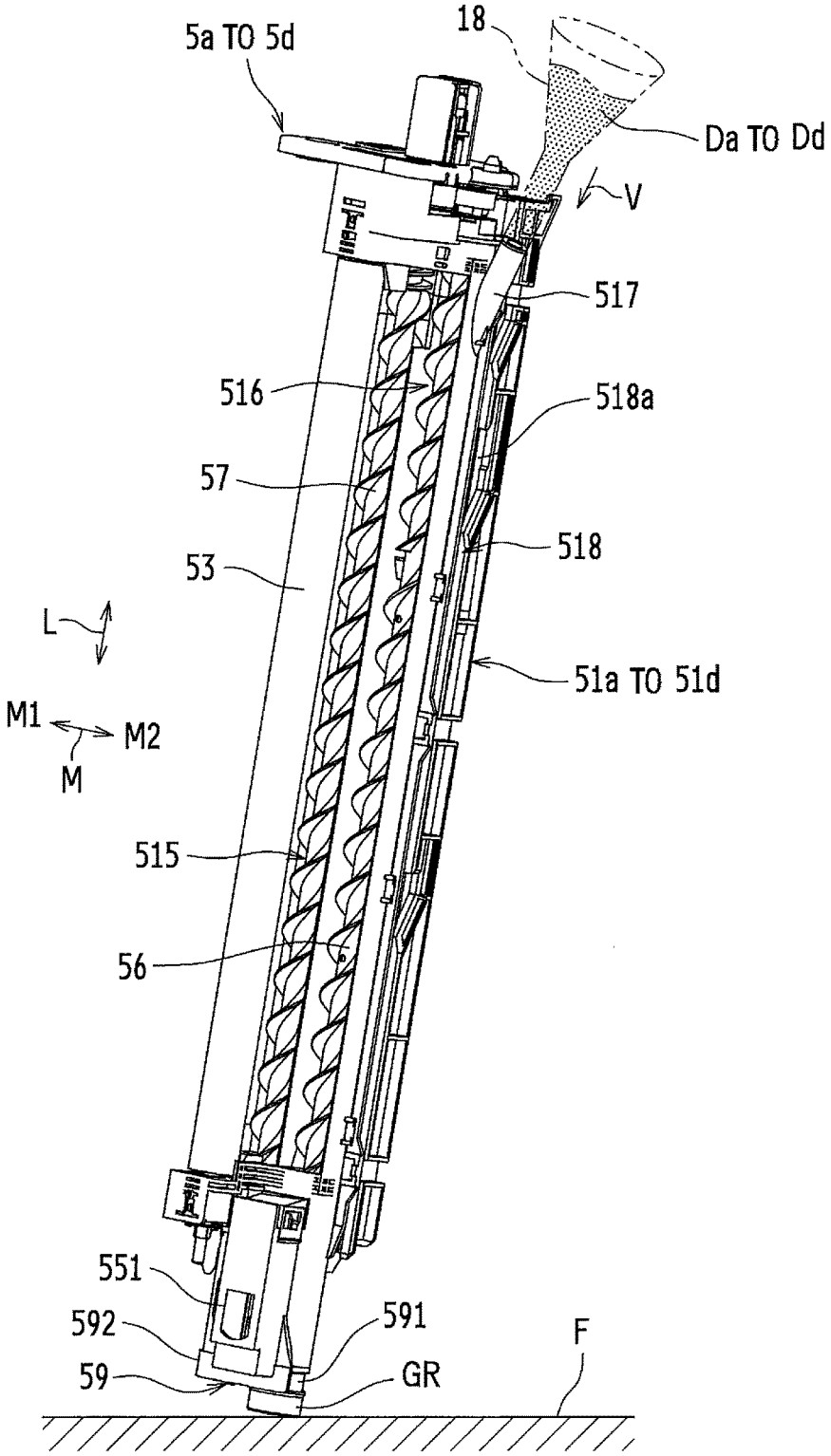
FIG. 5 is a schematic perspective view illustrating an example in which the developing device illustrated in FIG. 1 is filled with a developer from a filling portion.

FIG. 5 is a schematic perspective view illustrating an example in which one of the developing devices 5*a* to 5*d* illustrated in FIG. 1 is filled with the corresponding one of the developers Da to Dd from the filling portion 517.

According to the present embodiment, since the developing tanks 51*a* to 51*d* include the filling portions 517 through which the developing tanks 51*a* to 51*d* are respectively filled with the developers Da to Dd, when an operator such as a service person fills the developing tanks 51*a* to 51*d* with the developers Da to Dd, it is possible to fill the developing tanks 51*a* to 51*d* with the developers Da to Dd from the respective filling portions 517. Thereby, it is possible to facilitate an operation of filling the developing tanks 51*a* to 51*d* with the developers Da to Dd. In addition, each of the filling portions 517 is provided on the other side M2 of the corresponding one of the developing tanks 51*a* to 51*d* in the width direction M, which is apart from the developing roller 53, and therefore, when the operator fills the developing tanks 51*a* to 51*d* with the developers Da to Dd, it is possible to suppress reaching of each of the developers Da to Dd, which have been filled from the filling portions 517, up to the one side M1 that is close to the developing roller 53 exposed from the corresponding one of the developing tanks 51*a* to 51*d*. Thereby, it is possible to prevent or reduce leakage of the developers Da to Dd from the developing tanks 51*a* to 51*d* due to shaking, for example, during transportation of the developing devices 5*a* to 5*d*, even when the developing devices 5*a* to 5*d* (more specifically, the image forming apparatus 100 provided with the developing devices 5*a* to 5*d*) are shipped from a factory in a state where the developing tanks 51*a* to 51*d* are respectively filled with the developers Da to Dd.

Moreover, in the present embodiment, since the filling portion 517 is provided on the other side M2 of the corresponding one of the developing tanks 51*a* to 51*d* in the width direction M, which is apart from the developing roller 53, although there is no limitation thereto, it is possible to perform filling with the developers Da to Dd from the filling portions 517 by using a filling assist member 18 (refer to FIG. 5) such as a funnel, for example, in a state where the developing devices 5*a* to 5*d* are caused to stand on an installation surface F (desirably, in a state where the developing devices 5*a* to 5*d* are caused to stand slightly obliquely so that the developing rollers 53 face upward) as illustrated in FIG. 5. Thereby, it is possible to smoothly fill the developing tanks 51*a* to 51*d* with the developers Da to Dd while causing the developers Da to Dd to fall down into the developing tanks 51*a* to 51*d* by gravity.

Examples of a shape of the filling portion 517 include a shape which is long in a filling direction V (refer to FIG. 2, FIG. 4, and FIG. 5) of the corresponding one of the developers Da to Dd. A shape of the filling portion 517, which is viewed from the filling direction V, is not limited in particular, and examples thereof include a round shape, an elliptical shape, and a polygonal shape. Moreover, an entire shape of the filling portion 517 is not limited in particular, and examples thereof include a cylindrical shape, an elliptical cylindrical shape, a rectangular cylindrical shape, a conical shape or an elliptical conical shape in each of which an inner diameter is gradually reduced as being closer to the inside of the corresponding one of the developing tanks 51*a* to 51*d*, and a pyramid shape in which an inner size gradually becomes small as being closer to the inside of the corresponding one of the developing tanks 51*a* to 51*d*. In the example, the filling portion 517 is in the cylindrical shape. The developing tanks 51*a* to 51*d* and the filling portions 517 are formed of a resin material and formed integrally.

<First Embodiment>

In the present embodiment, in each of the developing tanks 51*a* to 51*d*, two or more (in this example, two) flow paths through which the corresponding one of the developers Da to Dd is caused to pass are formed. The first flow path 515 which is one of the two or more flow paths causes the corresponding one of the developers Da to Dd to pass through the first flow path 515 on the one side M1 in the width direction M, and the second flow path 516 which is another one of the two or more flow paths causes the corresponding one of the developers Da to Dd to pass through the second flow path 516 on the other side M2 in the width direction M, which is further apart from the developing roller 53 than the first flow path 515 is. The filling portion 517 is provided for each of the developing tanks 51*a* to 51*d* so that the corresponding one of the developers Da to Dd flows into the second flow path 516. Thereby, when filling the developing tanks 51*a* to 51*d* with the developers Da to Dd, an operator is able to cause each of the developers Da to Dd, filling of which is performed from the filling portion 517, to flow into the second flow path 516 on the other side M2 that is apart from the developing device 53. Accordingly, it is possible to suppress reaching of each of the developers Da to Dd in the second flow path 516 up to the first flow path 515 on the one side M1 which is close to the developing roller 53. Thereby, it is possible to prevent or reduce leakage of the developers Da to Dd from the developing tanks 51*a* to 51*d* due to shaking, for example, during transportation of the developing devices 5*a* to 5*d*, even when the developing devices 5*a* to 5*d* (more specifically, the image forming apparatus 100 provided with the developing devices 5*a* to 5*d*) are shipped from a factory in a state where the developing tanks 51*a* to 51*d* are respectively filled with the developers Da to Dd.

<Second Embodiment>

In a case where the filling portions 517 are respectively provided for the developing tanks 51*a* to 51*d* so that the filling direction V of each of the developers Da to Dd is orthogonal or approximately orthogonal to the longitudinal direction L of the corresponding one of the developing tanks 51*a* to 51*d*, for example, when an operator performs filling with the developers Da to Dd from, the filling portions 517 in a state where the developing devices 5*a* to 5*d* are caused to stand on the installation surface F, it becomes difficult to cause the developers Da to Dd to fall down into the developing tanks 51*a* to 51*d* by gravity, thus making it difficult to smoothly fill the developing tanks 51*a* to 51*d* with the developers Da to Dd. Accordingly, for example, when the operator performs filling with the developers Da to Dd from, the filling portions 517 in the state where the developing devices 5*a* to 5*d* are caused to stand on the installation surface F, it is desired, to smoothly fill the developing tanks 51*a* to 51*d* with the developers Da to Dd.

In this respect, in the present embodiment, the filling portions 517 are respectively provided for the developing tanks 51*a* to 51*d* so that the filling direction V of each of the developers Da to Dd is oblique with respect to the longitudinal direction L of the corresponding one of the developing tanks 51*a* to 51*d*. Thereby, for example, when filling with the developers Da to Dd is performed from, the filling portions 517 in a state where an operator stands the developing devices 5*a* to 5*d* on the installation surface F so that a downstream side of each of the filling portions 517 in the filling direction V [side of each filling outlet 517*a* (refer to FIG. 3 and FIG. 4) at a time of filling with the corresponding one of the developers Da to Dd] faces downward (refer to FIG. 5), it is possible to facilitate causing the developers Da to Dd to fall down into the developing tanks 51*a* to 51*d* by gravity. It is thereby possible to smoothly fill the developing tanks 51*a* to 51*d* with the developers Da to Dd.

Here, examples of the filling direction V which is oblique with respect to the longitudinal direction L of the corresponding one of the developing tanks 51*a* to 51*d* include a direction parallel or approximately parallel to the width direction M (horizontal direction), a direction parallel or approximately parallel to the vertical direction Z, and a direction intersecting the width direction M (horizontal direction) and the vertical direction Z. In the example, the filling direction V which is oblique with respect to the longitudinal direction L of the corresponding one of the developing tanks 51*a* to 51*d* is the direction parallel or approximately parallel to the width direction M (horizontal direction).

Note that, each of the filling portions 517 is provided with a lid member 517*c* (refer to FIG. 2). Thereby, it is possible to suppress leakage of the developers Da to Dd from the developing tanks 51*a* to 51*d* via the filling portions 517 when the developer Da to Dd are not desired to leak from the filling portions 517, for example, during an operation or transportation of the developing devices 5*a* to 5*d*. In the example, the lid member 517*c* covers an end part [part on a side of a filling inlet 517*b* (refer to FIG. 2 to FIG. 4) at the time of filling with the corresponding one of the developers Da to Dd] of the filling portion 517, which is on an upstream side in the filling direction V. However, there is no limitation thereto, and the lid member 517*c* may cover an entire space of an inside of the filling portion 517. In this case, when each of the filling portions 517 is provided for the corresponding one of the developing tanks 51*a* to 51*d* so that the side of the filling inlet 517*b* is set to be higher than the side of the filling outlet 517*a* in the filling direction V, leakage of the developers Da to Dd from the developing tanks 51*a* to 51*d* via the filling portions 517 is prevented or reduced, and therefore the lid members 517*c* may be omitted.

<Third Embodiment>

When the filling portions 517 are provided for the developing tanks 51*a* to 51*d* so that the filling direction V (side of the filling outlet 517*a*) of each of the developers Da to Dd faces obliquely outward in the longitudinal direction L of the corresponding one of the developing tanks 51*a* to 51*d*, for example, when filling with the developers Da to Dd is performed from the filling portions 517 in a state where an operator stands the developing devices 5*a* to 5*d* on the installation surface F so that the side of the filling outlet 517*a* of each of the filling portions 517 faces downward, height positions of the filling portions 517 are lower than center parts thereof in the developing tanks 51*a* to 51*d*, and thus storing amounts of the developers Da to Dd are likely to decrease accordingly, and, in the aforementioned state, it becomes difficult to store desired amounts of the developers Da to Dd with which the developing tanks 51*a* to 51*d* are filled. Accordingly, for example, when filling with the developers Da to Dd is performed from the filling portions 517 in the state where the operator stands the developing devices 5*a* to 5*d* on the installation surface F so that the side of the filling outlet 517*a* of each of the filling portions 517 faces downward, it is desired to secure, in the aforementioned state, the desired amounts of the developers Da to Dd with which the developing tanks 51*a* to 51*d* are filled.

In this respect, in the present embodiment, the filling portions 517 are provided for the developing tanks 51*a* to 51*d* so that the filling direction V of each of the developers Da to Dd extends obliquely inward (for example, toward the center part) in the longitudinal direction L of the corresponding one of the developing tanks 51*a* to 51*d*. In the example, each of the filling portions 517 is provided for an end part of the corresponding one of the developing tanks 51*a* to 51*d*, which is on the one side L1 (in the example, one side Y1) in the longitudinal direction L. This makes it possible to set the height positions of the filling portions 517 to be higher than the center parts in the developing tanks 51*a* to 51*d*, for example, when filling with the developers Da to Dd is performed from the filling portions 517 in the state where the operator stands the developing devices 5*a* to 5*d* on the installation surface F so that the side of the filling outlet 517*a* of each of the filling portions 517 faces downward (refer to FIG. 5), and therefore it is possible to make the amounts of the stored developers Da to Dd large accordingly. Thus, in the aforementioned state, it is possible to store the desired amounts of the developers Da to Dd with which the developing tanks 51*a* to 51*d* are filled.

<Fourth Embodiment>

Figure 12:
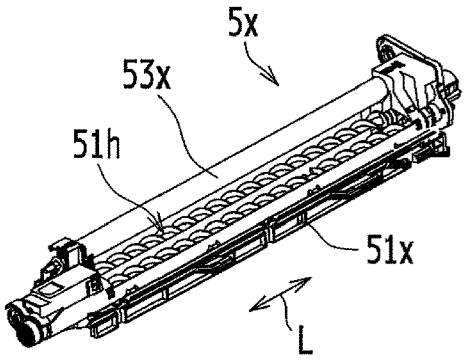
FIG. 12 is a schematic perspective view illustrating a state where an upper cover member is detached from the developing device illustrated in FIG. 11.
Figure 13:
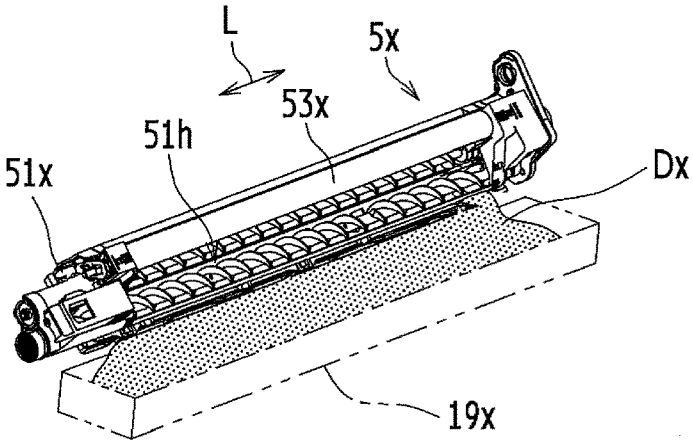
FIG. 13 is a perspective view illustrating a state where a developer is removed in the developing device illustrated in FIG. 12.

FIG. 13 is a perspective view illustrating a state where a developer Dx is removed in the developing device 5*x* of the related art illustrated in FIG. 12.

Figure 11:
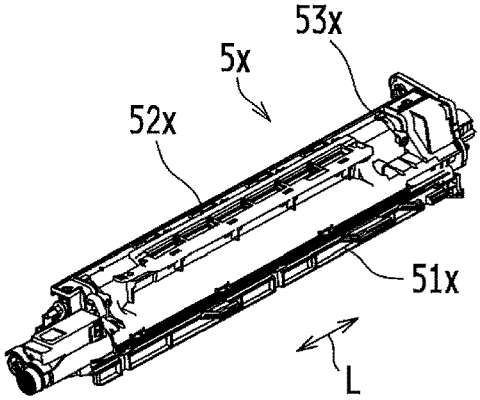
FIG. 11 is a schematic perspective view illustrating an example of a developing device of the related art.

In the developing device 5*x*, when an operator removes the developer Dx in the developing tank 51*x* from the developing tank 51*x* in a case of replacing the developer Dx, normally, a receiving tray 19*x* (refer to FIG. 13) that is as long as an entire length of the developing tank 51*x* in the longitudinal direction L and receives the developer Dx is prepared, and the developer Dx is discharged from the upper opening 51*h* of the developing tank 51*x* to the receiving tray 19*x* after the upper cover member 52*x* (refer to FIG. 11) is detached from the developing tank (refer to FIG. 12). Therefore, when the operator removes the developer Dx in the developing tank 51*x* from, the developing tank 51*x*, it is desired to perform an operation of detaching the upper cover member 52*x* from the developing tank 51*x*, and thus there is inconvenience that preparation of the receiving tray 19*x* that is as long as the entire length of the developing tank 51*x* in the longitudinal direction L and receives the developer Dx is desired, in addition to labor of the discharging operation of the developer Dx from the developing tank 51*x*. Accordingly, when the developer Dx in the developing tank 51*x* is removed from the developing tank 51*x*, it is desired to facilitate the discharging operation of the developer from the developing tank and to use a small-sized container that stores the discharged developer.

In this respect, the developing devices 5*a* to 5*d* according to the present, embodiment respectively discharge the developers Da to Dd from the developing tanks 51*a* to 51*d* as below.

Figure 6:
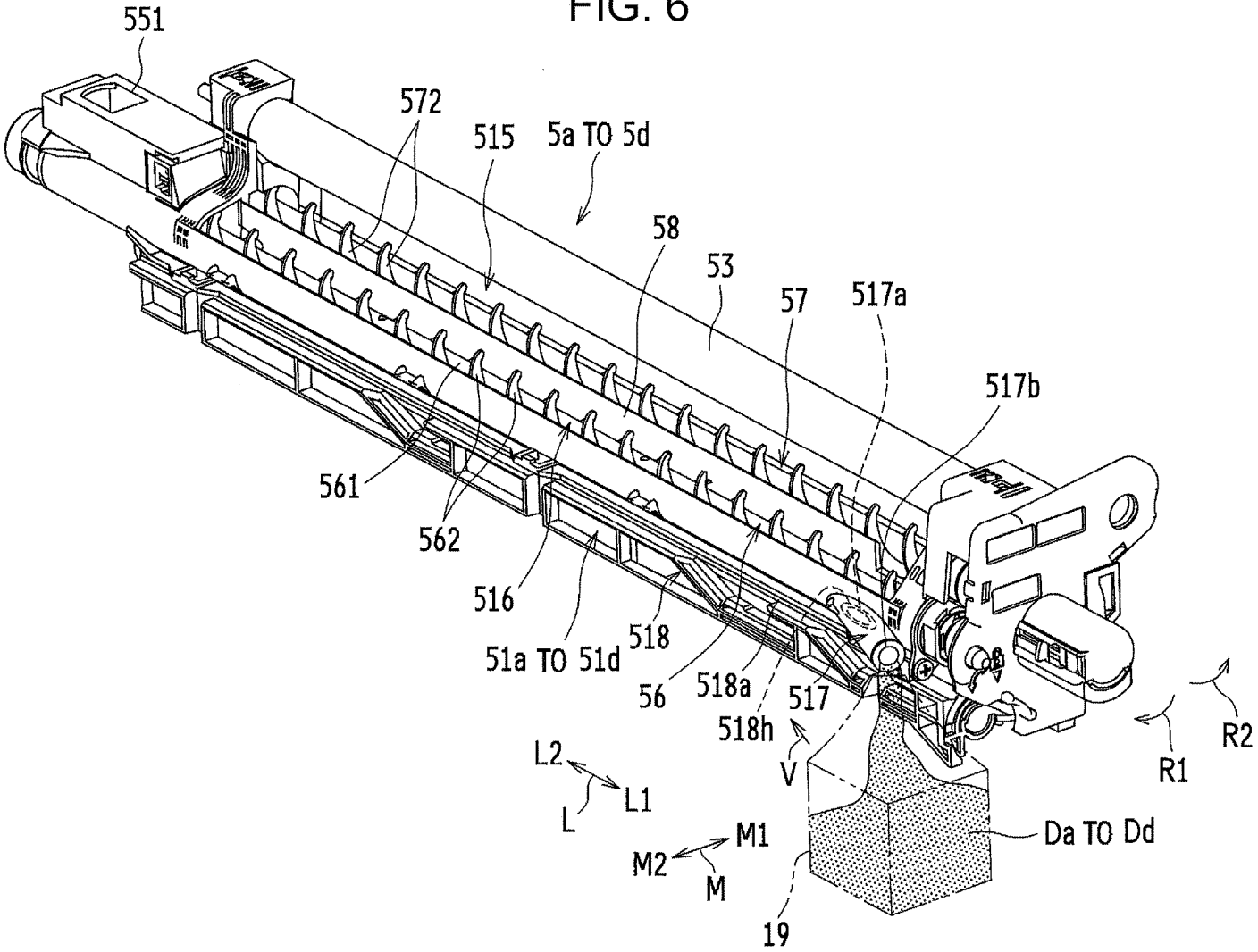
FIG. 6 is a schematic perspective view in an obliquely downward direction of the front side of the developing device which is illustrated in FIG. 1 and is in a state where the developer is discharged.

FIG. 6 is a schematic perspective view in an obliquely downward direction of the front side of one of the developing devices 5*a* to 5*d*, which is illustrated in FIG. 1 and is in a state where the corresponding one of the developers Da to Dd is discharged.

As illustrated in FIG. 6, each of the developing devices 5*a* to 5*d* includes the first spiral member 56 and the second spiral member 57 and uses an operation of conveying the corresponding one of the developers Da to Dd by the first spiral member 56 and the second spiral member 57 to thereby discharge, from the filling portion 517, the corresponding one of the developers Da to Dd which are in the developing tanks 51*a* to 51*d*.

Specifically, the filling portion 517 has the filling outlet 517*a*, which is at the end on the downstream side in the filling direction V, facing the first spiral member 56. When the first spiral member 56 and the second spiral member 57 rotate, by the rotation of the first spiral member 56 that the filling portion 517 faces, the corresponding one of the developers Da to Dd is conveyed to the one side L1 of the longitudinal direction L while being agitated and reaches the filling portion 517. Accordingly, each of the developers Da to Dd is pushed out to a side of the filling portion 517 and discharged to an outside from the filling portion 517. In the example, each of the filling portions 517 is provided for the corresponding one of the developing tanks 51*a* to 51*d* so as to branch off from the second flow path 516 in a direction in which the corresponding one of the developers Da to Dd is conveyed.

In this manner, by using the operation of conveying each of the developers Da to Dd by the first spiral member 56 and the second spiral member 57 to thereby discharge, from the filling portion 517, each of the developers Da to Dd in the developing tanks 51*a* to 51*d*, when the developers Da to Dd in the developing tanks 51*a* to 51*d* are respectively removed from the developing tanks 51*a* to 51*d*, it is possible to discharge each of the developers Da to Dd in the developing tanks 51*a* to 51*d* from the filling portion 517 while operating (specifically, rotating) the first spiral member 56 and the second spiral member 57. Thereby, it is possible to facilitate the discharging operation of the developers Da to Dd, which are in the developing tanks 51*a* to 51*d*, from the developing tanks 51*a* to 51*d*. In addition, at a time of discharging each of the developers Da to Dd in the developing tanks 51*a* to 51*d* from the corresponding one of the filling portions 517, it is possible to use a container 19 (refer to FIG. 6) that is small sized and stores the corresponding one of the discharged developers Da to Dd instead of the receiving tray 19*x* (refer to FIG. 13) of the related art that has a long length equivalent to the entire length of the corresponding one of the developing tanks 51*a* to 51*d* in the longitudinal direction L and receives the corresponding one of the developers Da to Dd.

Note that, when each of the developers Da to Dd in the developing tanks 51*a* to 51*d* is discharged from the filling portion 517, an operator may operate (specifically, rotate) the first spiral member 56 and the second spiral member 57, or may automatically operate (specifically, rotate) the first spiral member 56 and the second spiral member 57 by rotation driving force from the rotation driving portion (not illustrated).

<Fifth Embodiment>

In the present embodiment, the first spiral member 56 and the second spiral member 57 are configured to agitate the corresponding one of the developers Da to Dd in a direction intersecting the longitudinal direction L of the corresponding one of the developing tanks 51*a* to 51*d*. In a circumferential region in a circumferential direction viewed from the longitudinal direction L of the corresponding one of the developing tanks 51*a* to 51*d*, the filling portion 517 is provided within a half-circumferential region α (refer to FIG. 3) on a side on which the corresponding one of the developers Da to Dd is moved from a lower side to an upper side in the corresponding one of the developing tanks 51*a* to 51*d* by the first spiral member 56 that the filling portion 517 faces. Here, the half-circumferential region α is a half-circumferential region on the side on which the corresponding one of the developers Da to Dd is moved from, the lower side to the upper side in the corresponding one of the developing tanks 51*a* to 51*d* when a virtual vertical line γ1 (refer to FIG. 3) that passes through the center β2 (specifically, a rotation center) (refer to FIG. 3) of the first spiral member 56 is set as a boundary. Thereby, when the developers Da to Dd are discharged from the developing tanks 51*a* to 51*d*, it is possible to convey each of the developers Da to Dd raised from the lower side (bottom part) to the upper side in the corresponding one of the developing tanks 51*a* to 51*d* by the first spiral member 56 that the filling portion. 517 faces toward, the filling portion 517 provided within the half-circumferential region α in the circumferential region of the corresponding one of the developing tanks 51*a* to 51*d*. Thereby, it is possible to facilitate discharging the developers Da to Dd in the developing tanks 51*a* to 51*d* from the filling portions 517.

<Sixth Embodiment>

When the filling portion 517 is provided for each of the developing tanks 51*a* to 51*d* so that a height position of the center β1 (refer to FIG. 3) is higher than a height position of the center β2 of the first spiral member 56 that the filling portion 517 faces, the corresponding one of the developers Da to Dd is raised from the lower side to the upper side in the corresponding one of the developing tanks 51*a* to 51*d* by the first spiral member 56 that the filling portion 517 faces and falls down on the way by gravity, and thus it becomes difficult to efficiently discharge the developers Da to Dd from the filling portions 517, thus making it difficult to effectively discharge, from the filling portions 517, the developers Da to Dd in the developing tanks 51*a* to 51*d*. Accordingly, it is desired to effectively discharge, from the filling portions 517, the developers Da to Dd in the developing tanks 51*a* to 51*d*.

In this respect, in the present embodiment, the filling portion 517 is provided for each of the developing tanks 51*a* to 51*d* so that the height position of the center β1 is equal to or lower than the height position of the center β2 (specifically, the center of each of the width direction M, the longitudinal direction L, and the vertical direction Z) of the first spiral member 56 that the filling portion 517 faces. Here, the center β1 of the filling portion 517 may be set as the center of the filling outlet 517*a* which is at the end on the downstream side in the filling direction V. Thereby, at a time of discharging the developers Da to Dd from the developing tanks 51*a* to 51*d*, it is possible to efficiently discharge, from the filling portion 517, each of the developers Da to Dd raised from the lower side to the upper side in the corresponding one of the developing tanks 51*a* to 51*d* by the first spiral member 56 that the filling portion 517 faces. This makes it possible to effectively discharge the developers Da to Dd in the developing tanks 51*a* to 51*d* from the filling portions 517.

Note that, in a case where the shape viewed from the filling direction V is a round shape, the center β1 of the filling portion 517 is the center of a circle, in a case where the shape viewed from the filling direction V is an elliptical shape, the center β1 is an intersection of a major axis and a minor axis, and in a case where the shape viewed from the filling direction V is a polygonal shape, the center β1 is an intersection, of diagonal lines. Moreover, the rotation direction in which the first spiral member 56 that the filling portion 517 faces is rotated at the time of discharging the corresponding one of the developers Da to Dd from, the corresponding one of the developing tanks 51*a* to 51*d* may be a forward rotation direction at a time of performing a developing operation by which development is performed by the developing roller 53 or may be a reverse rotation direction which is opposite to the forward rotation direction. In the example, the rotation direction in which the first spiral member 56 that the filling portion 517 faces is rotated at the time of discharging the corresponding one of the developers Da to Dd from the corresponding one of the developing tanks 51*a* to 51*d* is the first rotation direction R1 which is the forward rotation direction.

<Seventh Embodiment>

In a case where each of the agitating-conveying members includes an agitating-conveying portion in a spiral shape that rotates around an axis extending along the longitudinal direction L of the corresponding one of the developing tanks 51*a* to 51*d*, when the filling portion 517 is provided for each of the developing tanks 51*a* to 51*d* so as to face the agitating-conveying portion 562 and so that the filling direction V of the corresponding one of the developers Da to Dd intersects (in particular, is orthogonal to) a direction of the spiral shape (specifically, a direction along a screw blade intersecting the rotation axis 561) of the agitating-conveying portion 562, the spiral shape of the agitating-conveying portion 562 is likely to obstruct filling of the corresponding one of the developing tanks 51*a* to 51*d* with the corresponding one of the developers Da to Dd, thus making it difficult to smoothly fill the developing tanks 51*a* to 51*d* with the developers Da to Dd from the filling portions 517. Accordingly, it is desired to smoothly fill the developing tanks 51*a* to 51*d* with the developers Da to Dd from the filling portions 517.

In this respect, in the present embodiment, the first spiral member 56 that the filling portion 517 faces includes the agitating-conveying portion 562, and the filling portion 517 may be provided for each of the developing tanks 51*a* to 51*d* so as to face the agitating-conveying portion 562 of the first spiral member 56 and so that the filling direction V of the corresponding one of the developers Da to Dd is parallel or approximately parallel to the direction of the spiral shape (specifically, the direction along the screw blade intersecting the rotation axis 561) of the agitating-conveying portion 562. Thereby, it is possible to make the spiral shape of the agitating-conveying portion 562 less likely to obstruct filling of the corresponding one of the developing tanks 51*a* to 51*d* with the corresponding one of the developers Da to Dd, when an operator fills the developing tanks 51*a* to 51*d* with the developers Da to Dd. This makes it possible to smoothly fill the developing tanks 51*a* to 51*d* with the developers Da to Dd from the filling portions 517.

<Eighth Embodiment>

In the present embodiment, each of the developing tanks 51*a* to 51*d* is provided with the partition wall 58, and the filling portion 517 is provided for each of the developing tanks 51*a* to 51*d* so that the partition wall 58 is positioned on an extension of the filling direction V of the corresponding one of the developers Da to Dd. Thereby, when an operator fills the developing tanks 51*a* to 51*d* with the developers Da to Dd, it is possible to hinder each of the developers Da to Dd, with which the developing tanks 51*a* to 51*d* are filled from the filling portions 517, by the partition wall 58 so as to be less likely to reach the developing roller 53. Accordingly, even when the developing devices 5*a* to 5*d* (more specifically, the image forming apparatus 100 provided with the developing devices 5*a* to 5*d*) are shipped from a factory in the state where the developing tanks 51*a* to 51*d* are filled with the developers Da to Dd, it is possible to further suppress reaching of the developers Da to Dd to the developing rollers 53. Thereby, it is possible to prevent or further reduce leakage of the developers Da to Dd from, the developing tanks 51*a* to 51*d* due to shaking, for example, during transportation of the developing device 5*a* to 5*d*.

<Ninth Embodiment>

In the present embodiment, the filling portion 517 is provided on a wall surface 518*a* (refer to FIG. 2 to FIG. 6) of each of the developing tanks 51*a* to 51*d*, which is on one side (in the example, the other side M2 and the left side viewed from the front) in the width direction M. Thereby, at the time of filling the developing tanks 51*a* to 51*d* with the developers Da to Dd, it is possible to perform filling with each of the developers Da to Dd via the filling portion 517 from the wall surface 518*a* (specifically, a surface between 45 degrees upward and 45 degrees downward with a virtual horizontal line γ2 (refer to FIG. 3) passing through the center β2 of the first spiral member 56 as a reference) of the corresponding one of the developing tanks 51*a* to 51*d*, which is on the one side (in the example, the other side M2 and the left side viewed from the front) in the width direction M. Thereby, it is possible to reliably fill the developing tanks 51*a* to 51*d* with the developers Da to Dd from the filling portions 517. Moreover, at the time of discharging the developers Da to Dd from the developing tanks 51*a* to 51*d*, it is possible to discharge each of the developers Da to Dd from the filling portion 517 provided on the wall surface 518*a* of the corresponding one of the developing tanks 51*a* to 51*d*, which is on the one side (in the example, the other side M2 and the left side viewed from the front) in the width direction M, for example, in a state where the developing devices 5*a* to 5*d* are separated from the image forming apparatus 100 and laid in a horizontal or approximately horizontal position (refer to FIG. 6).

Specifically, on a side wall 518 (refer to FIG. 2 to FIG. 6) of each of the developing tanks 51*a* to 51*d*, which is on the one side (in the example, the other side M2 and the left side viewed from the front) in the width direction M, a through hole 518*h* (refer to FIG. 3, FIG. 4, and FIG. 6) along the filling direction V is provided, and the filling outlet 517*a* of the filling portion 517 communicates with the through hole 518*h*.

In the present embodiment, the filling portion 517 may be provided so that a lower end of the filling outlet 517*a* reaches a bottom part (lowest point) of the corresponding one of the developing tanks 51*a* to 51*d*. Thereby, at the time of discharging the developers Da to Dd from the developing tanks 51*a* to 51*d*, it is possible to reliably discharge the developers Da to Dd.

<Tenth Embodiment>

Figure 7:
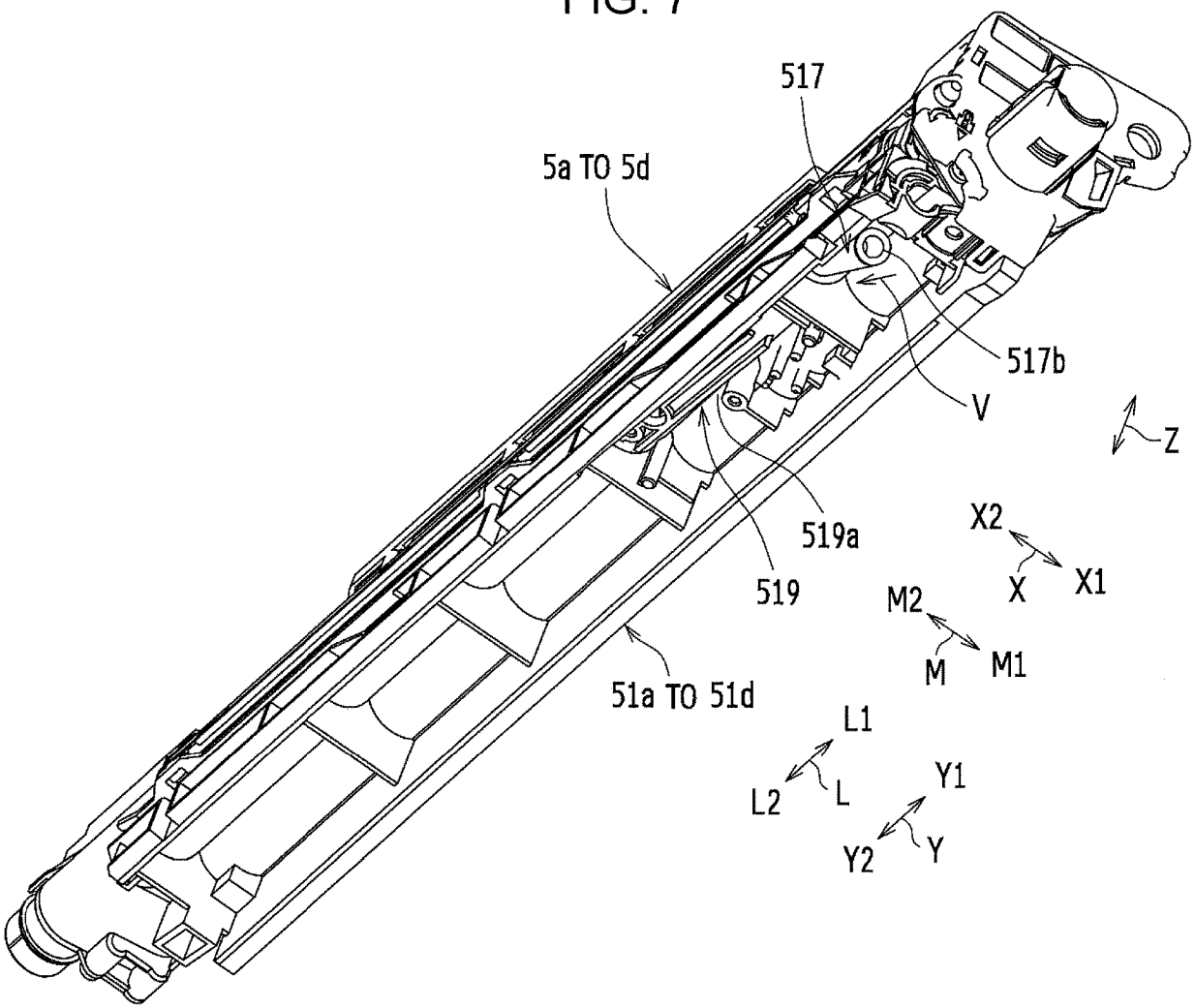
FIG. 7 is a schematic, perspective view in an obliquely upward direction of the front side in a state where the filling portion is provided in a lower surface of a developing tank according to another example of the developing device illustrated in FIG. 1.
Figure 8:
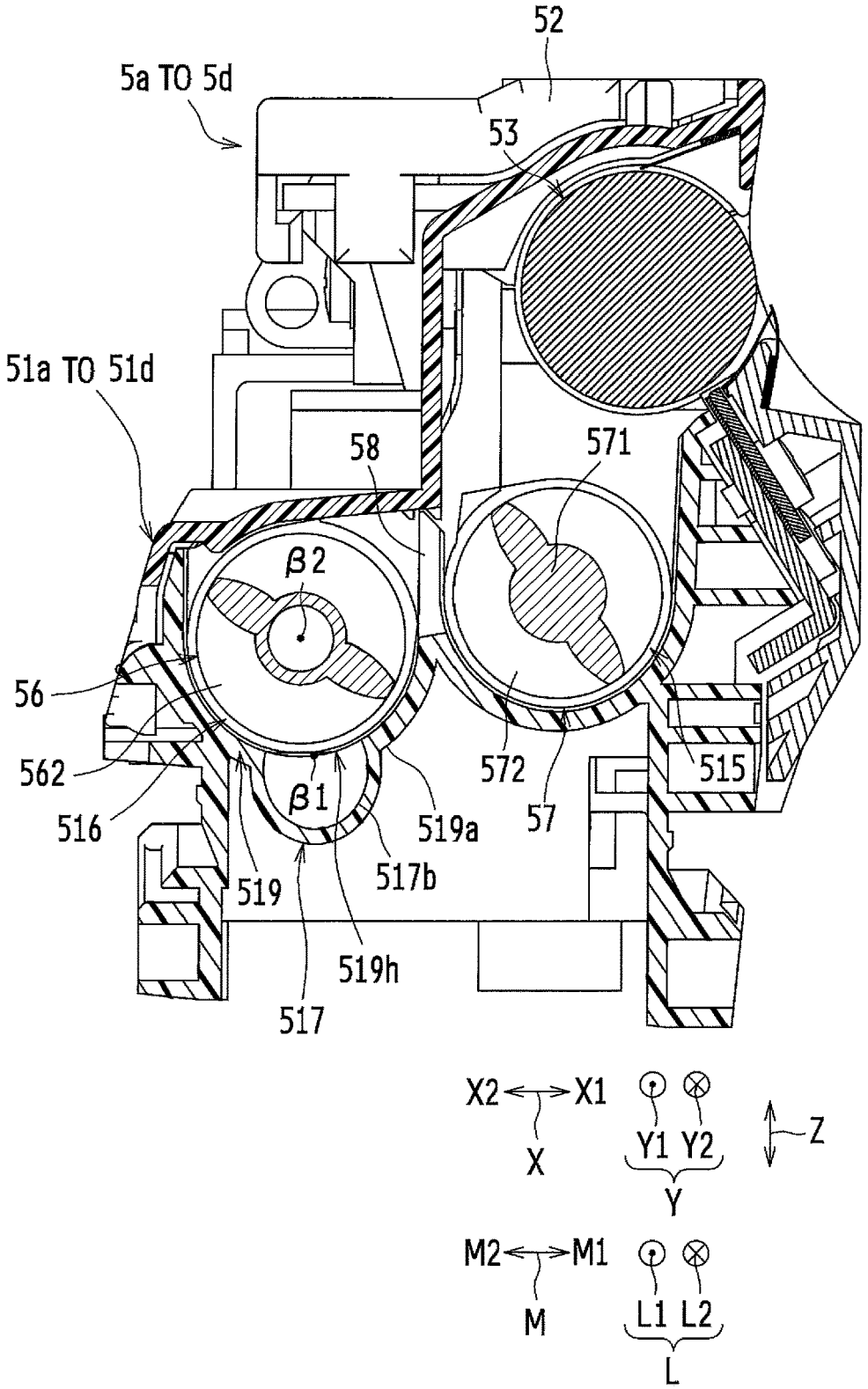
FIG. 8 is a schematic cross sectional view illustrating the state where the filling portion is provided in the lower surface of the developing tank according to another example of the developing device illustrated in FIG. 1.

FIG. 7 illustrates another example of the developing devices 5*a* to 5*d* illustrated in FIG. 1 and is a schematic perspective view in an obliquely upward direction of the front side in a state where the filling portion 517 is provided in a lower surface 519*a* of the corresponding one of the developing tanks 51*a* to 51*d*. FIG. 8 illustrates another example of the developing devices 5*a* to 5*d* illustrated in FIG. 1 and is a schematic cross sectional view illustrating the state where the filling portion 517 is provided in the lower surface 519*a* of the corresponding one of the developing tanks 51*a* to 51*d*.

In each of the developing devices 5*a* to 5*d*, as illustrated in FIG. 7 and FIG. 8, the filling portion 517 is provided in the lower surface 519*a* (specifically, a surface on a side lower than 45 degrees downward with the virtual horizontal line γ2 passing through the center β2 of the first spiral member 56 that the filling portion 517 faces as a reference) of the corresponding one of the developing tanks 51*a* to 51*d*. The center β1 (refer to FIG. 8) of the filling outlet 517*a* in the filling portion 517 may coincide or approximately coincide with the center β2 (refer to FIG. 8) of the second spiral member 57 in the width direction M, or may be deviated therefrom. Thereby, at the time of filling the developing tanks 51*a* to 51*d* with the developers Da to Dd, it is possible to perform filling with each of the developers Da to Dd via the filling portion 517 from the lower surface 519*a* of the corresponding one of the developing tanks 51*a* to 51*d*. This makes it possible to reliably fill the developing tanks 51*a* to 51*d* with the developers Da to Dd from the filling portions 517. Moreover, at the time of discharging the developers Da to Dd from the developing tanks 51*a* to 51*d*, it is possible to discharge each of the developers Da to Dd from the filling portion 517 provided on the lower surface 519*a* of the corresponding one of the developing tanks 51*a* to 51*d* in the state where the corresponding one of the developing devices 5*a* to 5*d* separated from the image forming apparatus 100 is laid in a horizontal or approximately horizontal position.

Specifically, on a lower wall 519 of each of the developing tanks 51*a* to 51*d*, a through hole 519*h* (refer to FIG. 8) along the filling direction V is provided, and the filling outlet 517*a* of the filling portion 517 communicates with the through hole 519*h*.

<Eleventh Embodiment>

Figure 9:
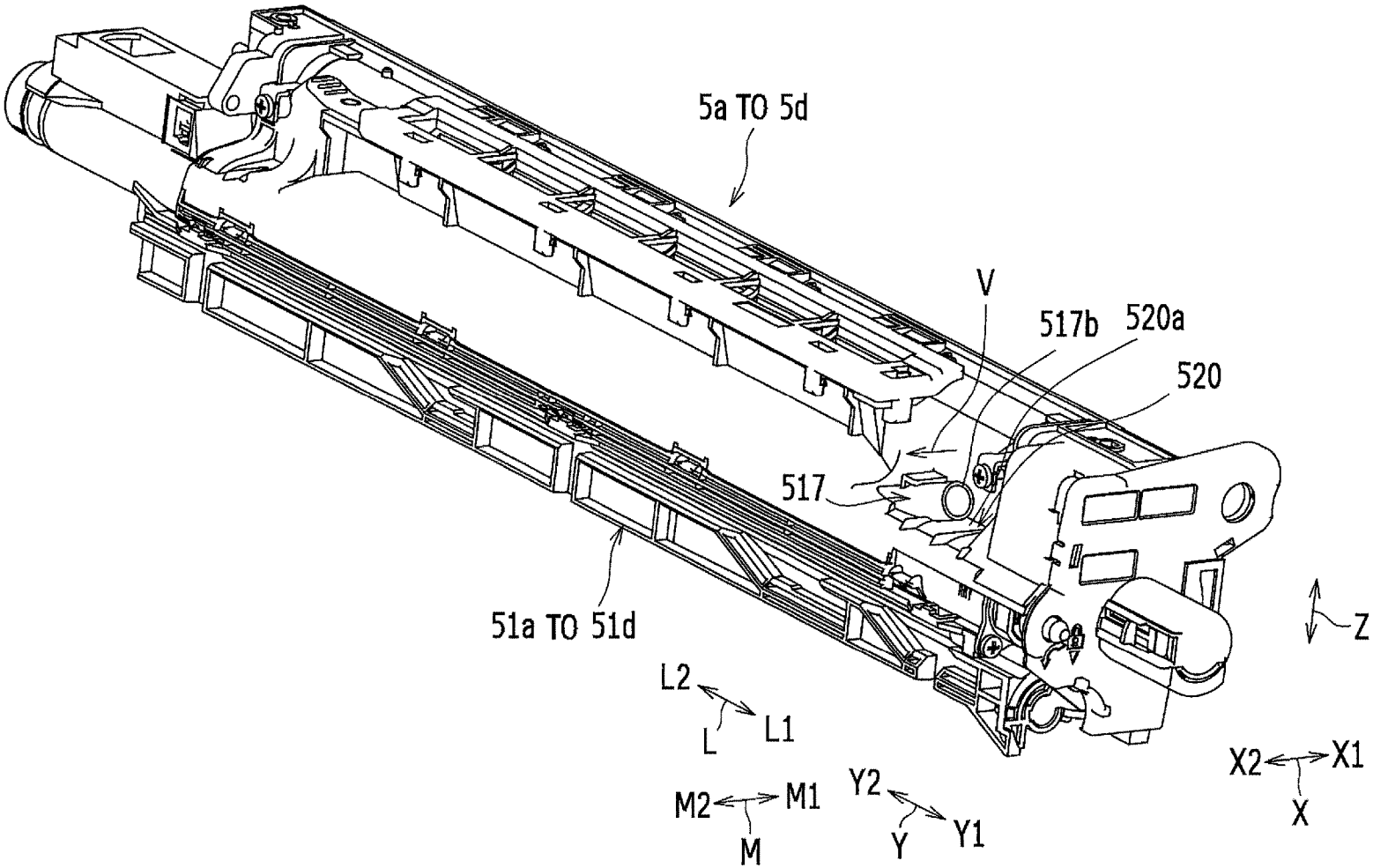
FIG. 9 is a schematic perspective view in an obliquely downward direction of the front side in a state where the filling portion is provided in an upper surface of the developing tank according to still another example of the developing device illustrated in FIG. 1.
Figure 10:
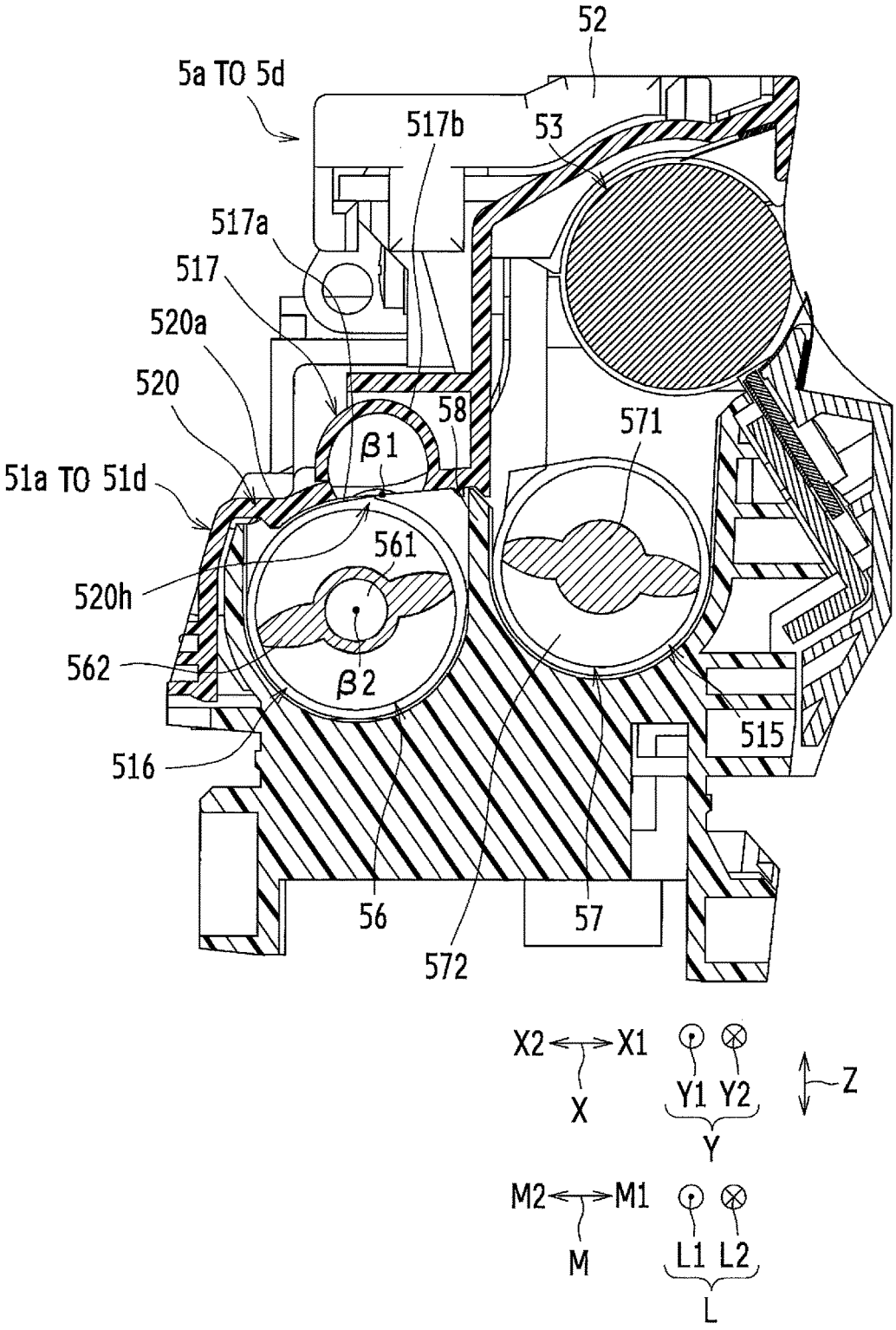
FIG. 10 is a schematic cross sectional view illustrating the state where the filling portion is provided in the upper surface of the developing tank according to still another example of the developing device illustrated in FIG. 1.

FIG. 9 illustrates still another example of the developing devices 5*a* to 5*d* illustrated in FIG. 1 and is a schematic perspective view in an obliquely downward direction of the front side in a state where the filling-portion 517 is provided in an upper surface 520*a* of the corresponding one of the developing tanks 51*a* to 51*d*. FIG. 10 illustrates still another example of the developing devices 5*a* to 5*d* illustrated in FIG. 1 and is a schematic cross sectional view illustrating the state where the filling portion 517 is provided in the upper surface 520*a* of the corresponding one of the developing tanks 51*a* to 51*d*.

In each of the developing devices 5*a* to 5*d*, as illustrated in FIG. 9 and FIG. 10, the filling portion 517 is provided in the upper surface 520*a* (specifically, a surface on a side upper than 45 degrees downward with the virtual horizontal line γ2 passing through the center β2 of the second spiral member 57 that the filling portion 517 faces as the reference) of each of the developing tanks 51*a* to 51*d*. In the example, the center β1 (refer to FIG. 10) of the filling outlet 517*a* in the filling portion 517 may coincide or approximately coincide with the center β2 (refer to FIG. 10) of the second spiral member 57 in the width direction M, or may be deviated therefrom. Thereby, at the time of filling the developing tanks 51*a* to 51*d* with the developers Da to Dd, it is possible to perform filling with each of the developers Da to Dd via the filling portion 517 from the upper surface 520*a* of the corresponding one of the developing tanks 51*a* to 51*d*. This makes it possible to reliably fill the developing tanks 51*a* to 51*d* with the developers Da to Dd from the filling portions 517. Moreover, at the time of discharging the developers Da to Dd from the developing tanks 51*a* to 51*d*, it is possible to discharge each of the developers Da to Dd from the filling portion 517 provided on the upper surface 520*a* of the corresponding one of the developing tanks 51*a* to 51*d* in a state where the corresponding one of the developing devices 5*a* to 5*d* separated from the image forming apparatus 100 is laid upside-down in a horizontal or approximately horizontal position.

Specifically, on an upper wall 520 of each of the developing tanks 51*a* to 51*d*, a through hole 520*h* (refer to FIG. 10) along the filling direction V is provided, and the filling outlet 517*a* of the filling portion 517 communicates with the through hole 520*h*.

<Other Embodiments>

Note that, two or more filling portions 517 may be provided in each of the developing tanks 51*a* to 51*d*. Moreover, at least two from the first embodiment to the eleventh embodiment may be combined.

The disclosure is not limited to the above-described embodiments, and may be carried out in various other forms. Therefore, the embodiments are merely exemplifications in all respects, and should not be limitedly interpreted. The scope of the disclosure is indicated by the scope of the Claims, and is not restricted by description of the specification in any way. Furthermore, all modifications and changes that belong to a range of equivalency of the scope of the Claims are encompassed in the scope of the disclosure.

The present disclosure contains subject matter related to that disclosed in Japanese Priority Patent Application JP 2017-101894 filed in the Japan Patent Office on May 23, 2017, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A developing device comprising: a developing tank that is long in shape and stores a developer; and a developer carrier that carries the developer stored in the developing tank, wherein the developing tank includes a filling portion through which the developing tank is filled with the developer, the developer carrier is provided on one side in a width direction that is orthogonal to both a longitudinal direction of the developing tank and a vertical direction of the developing tank, the filling portion is provided on the other side of the developing tank in the width direction, the other side being apart from the developer carrier, an agitating-conveying member that conveys the developer in the developing tank in the longitudinal direction of the developing tank while agitating the developer, wherein the developer in the developing tank is discharged from the filling portion by using an operation of conveying the developer by the agitating-conveying member, and the filling portion is provided for the developing tank so that a height position of a center of the filling portion is equal to or lower than a height position of a center of the agitating-conveying member.

2. The developing device according to claim 1, wherein two or more flow paths through each of which the developer is caused to pass are formed in the developing tank, and the developer is caused to pass through a first flow path that is one of the two or more flow paths on the one side in the width direction, and the developer is caused to pass through a second flow path that is another one of the two or more flow paths on the other side in the width direction, the second flow path being further apart from the developer carrier than the first flow path is, and the filling portion is provided for the developing tank so that the developer flows into the second flow path.

3. The developing device according to claim 1, wherein the filling portion is provided for the developing tank so that a filling direction of the developer is oblique with respect to the longitudinal direction of the developing tank.

4. The developing device according to claim 3, wherein the filling portion is provided for the developing tank so that the filling direction of the developer extends obliquely inward in the longitudinal direction of the developing tank.

5. The developing device according to claim 1, wherein the agitating-conveying member is configured to agitate the developer in a direction intersecting the longitudinal direction of the developing tank, and the filling portion is provided within a half-circumferential region, of an entire circumferential region in a circumferential direction viewed from the longitudinal direction of the developing tank, on a side on which the developer is moved from a lower side to an upper side in the developing tank by the agitating-conveying member.

6. The developing device according to claim 1, further comprising an agitating-conveying member that conveys the developer in the developing tank in the longitudinal direction of the developing tank while agitating the developer, wherein the agitating-conveying member includes an agitating-conveying portion that is in a spiral shape and that rotates around an axis extending along the longitudinal direction of the developing tank, and the filling portion is provided for the developing tank so that the filling portion faces the agitating-conveying portion and so that a filling direction of the developer is parallel to a direction of the spiral shape of the agitating-conveying portion.

7. The developing device according to claim 1, wherein a partition wall that partitions an inside of the developing tank in the width direction is provided in the developing tank, and the filling portion is provided for the developing tank so that the partition wall is located at a position corresponding to an extension of a filling direction of the developer.

8. The developing device according to claim 1, wherein the filling portion is provided on a wall surface of the developing tank on one side in the width direction.

9. The developing device according to claim 1, wherein the filling portion is provided on a lower surface of the developing tank.

10. The developing device according to claim 1, wherein the filling portion is provided on an upper surface of the developing tank.

11. An image forming apparatus comprising the developing device according to claim 1.

* * * * *